US011937693B2

(12) United States Patent
Rehage et al.

(10) Patent No.: US 11,937,693 B2
(45) Date of Patent: Mar. 26, 2024

(54) FURNITURE ELEMENT

(71) Applicant: PAUL HETTICH GMBH & CO. KG, Kirchlengern (DE)

(72) Inventors: Daniel Rehage, Münster (DE); Andreas Matthes, Chemnitz (DE); Waldemar Petker, Bünde (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 287 days.

(21) Appl. No.: 17/611,943

(22) PCT Filed: Apr. 15, 2020

(86) PCT No.: PCT/EP2020/060510

§ 371 (c)(1),
(2) Date: Nov. 17, 2021

(87) PCT Pub. No.: WO2020/233911

PCT Pub. Date: Nov. 26, 2020

(65) Prior Publication Data

US 2022/0225763 A1 Jul. 21, 2022

(30) Foreign Application Priority Data

May 20, 2019 (DE) ..... 10 2019 113 251.7

(51) Int. Cl.
*A47B 49/00* (2006.01)

(52) U.S. Cl.
CPC ..... *A47B 49/006* (2013.01)

(58) Field of Classification Search
CPC . A47B 49/006; A47B 49/008; A47B 49/0021; A47B 81/002
See application file for complete search history.

(56) References Cited

U.S. PATENT DOCUMENTS

| | | | | |
|---|---|---|---|---|
| 4,124,262 | A * | 11/1978 | Schill | A47B 49/004 312/307 |
| 4,959,582 | A * | 9/1990 | Meyer | A47B 88/60 312/307 |
| 6,349,657 | B1 * | 2/2002 | Wohlford | A47B 81/065 108/94 |
| 7,562,757 | B2 | 7/2009 | Dubach et al. | |
| 9,528,753 | B1 * | 12/2016 | Conner, Sr. | F25D 25/02 |
| 11,000,124 | B2 * | 5/2021 | Rehage | A47B 96/025 |
| 11,098,758 | B2 | 8/2021 | Rehage et al. | |
| 11,333,430 | B2 * | 5/2022 | Rehage | F25D 25/02 |
| 2002/0117943 | A1 * | 8/2002 | Gerkey | A47B 96/025 312/238 |

(Continued)

FOREIGN PATENT DOCUMENTS

| | | |
|---|---|---|
| AT | 502941 B1 | 5/2011 |
| DE | 19810007 A1 | 9/1999 |

(Continued)

OTHER PUBLICATIONS

Office Action dated Apr. 25, 2023 in related/corresponding IN Application No. 202147058336.

(Continued)

*Primary Examiner* — Daniel J Rohrhoff
(74) *Attorney, Agent, or Firm* — PATENT PORTFOLIO BUILDERS PLLC

(57) ABSTRACT

A shelf or rack includes at least one support plane and having a carcass and a bottom panel. Mutually facing support surfaces of the carcass or a support panel attached to an underside of the carcass and the bottom panel each have at least one groove in which rolling elements are guided. The carcass is movable relative to the bottom panel from a starting position into an intermediate position and further into an open position and back. In the intermediate position, the carcass is rotated in a direction of rotation relative to the bottom panel and is displaced in a predetermined direction.

(Continued)

Figure 1:
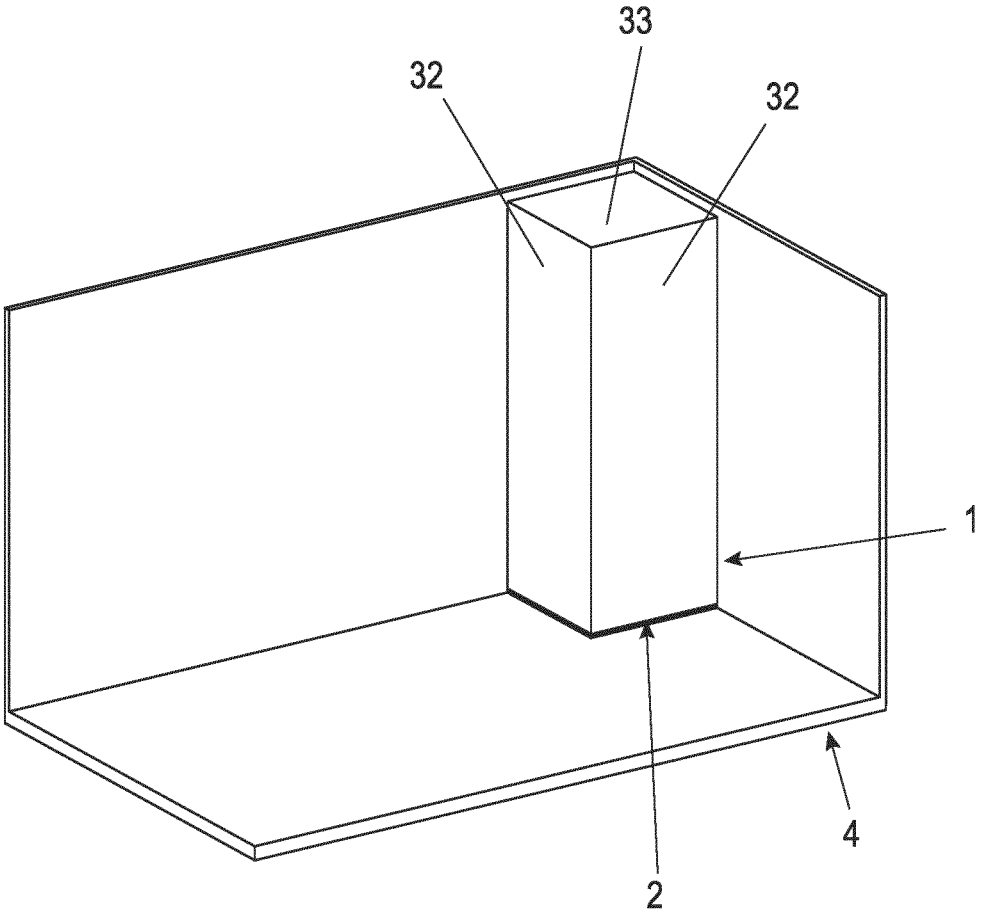

An opening and/or closing mechanism with a force accumulator assisting an opening and/or closing movement of the carcass is arranged on a surface of the bottom panel facing away from the carcass.

19 Claims, 30 Drawing Sheets

(56) References Cited

U.S. PATENT DOCUMENTS

| | | | | |
|---|---|---|---|---|
| 2008/0297016 | A1* | 12/2008 | Hsieh | A47B 49/004 312/249.2 |
| 2009/0223915 | A1* | 9/2009 | Thompson | A47B 61/04 211/144 |
| 2020/0018349 | A1* | 1/2020 | Rehage | A47B 77/10 |
| 2022/0142364 | A1* | 5/2022 | Held | A47B 88/497 |
| 2022/0211176 | A1* | 7/2022 | Rehage | A47B 77/10 |
| 2023/0091155 | A1* | 3/2023 | Rehage | A47B 96/025 211/153 |

FOREIGN PATENT DOCUMENTS

| | | | |
|---|---|---|---|
| DE | 102017106170 | A1 | 9/2018 |
| DE | 102018108977 | A1 | 10/2019 |
| EP | 1925238 | B1 | 8/2009 |
| JP | H10318669 | A | 12/1998 |
| WO | 2019042922 | A1 | 3/2019 |

OTHER PUBLICATIONS

International Search Report dated May 19, 2020 in related/corresponding International Application No. PCT/EP2020/060510.
Search Report dated Mar. 19, 2020 in related/corresponding DE Application No. 10 2019 113 251.7.
Written Opinion dated May 19, 2020 in related/corresponding International Application No. PCT/EP2020/060510.

* cited by examiner

FURNITURE ELEMENT

BACKGROUND AND SUMMARY OF THE INVENTION

Exemplary embodiments of the present invention relate to a furniture element, in particular a shelf or rack.

Furniture elements, such as shelves or racks in particular, in which a support plate and a shelf guided thereon and simultaneously movable in rotation and translation are arranged are known, for example, from JP 10318669 or DE 10 2017 106 170 A1.

In particular, the support plate described in the latter publication has proven itself in practice.

To move the shelf disclosed there, it is necessary to pull a side wall or a handle attached to it to rotate and advance the shelf.

Exemplary embodiments of the present invention are directed to further develop a furniture element, such as a shelf or a rack, in such a way that the operation of a movement of the shelf from an initial position to an unloading position or an opening movement of a rack closed by side walls in the initial position to a position in which shelves of the rack are accessible by a user is further simplified.

The furniture element according to the invention, in particular in the form of a base or a rack having at least one layer level, has a carcass or a shelf and a bottom panel.

A base in this case means tray floors, turntables, and shelves in household appliances.

Support surfaces of the carcass and bottom panel facing one another each have at least one running groove in which rolling elements are guided.

The carcass can be moved relative to the bottom panel from an initial position to an intermediate position and further to an open position and back.

In the intermediate position, the carcass is rotated relative to the bottom panel in one direction of rotation and displaced in a predetermined direction.

A mechanism for opening and/or closing with a force accumulator supporting an opening and/or closing movement of the carcass is arranged on a surface of the bottom panel facing away from the carcass.

Such a furniture element is characterized by its easily actuatable opening, where only a small amount of pressure needs to be applied to the carcass of the furniture element to move the carcass from the initial position, supported by the force of the force accumulator, to the opening position.

According to an advantageous embodiment variant, the mechanism is arranged on a surface of the bottom panel facing away from the carcass.

In accordance with an advantageous further development of the invention, a guide channel is provided in the bottom panel that determines the direction, in which a guide element is displaceably mounted and the mechanism is coupled to the guide element.

In addition, the force accumulator is fixed to the bottom panel and coupled with the guide element to support a sliding movement in the guide channel.

As a result, the entire mechanism of the mechanism is mounted under the bottom panel, invisible to the viewer.

In accordance with an advantageous further development, the mechanism comprises a pin projecting from the surface of the bottom panel remote from the carcass and a control disk rotatably mounted on the guide element and having a plurality of control elements for controlling movement of the control disk relative to the pin.

The pin and the control disk controlled by it ensure structurally simple, reliable control of the opening movement of the carcass of the furniture element.

In accordance with a further advantageous further development, the control disk is designed as an annular disk having a central opening surrounding the guide element. The control elements are arranged, in particular formed, on an annular surface facing the bottom panel.

First control elements are preferably designed as circular catch elements spaced at equal angular distance from each other with a recess open towards the center of the control disk.

This makes it possible, in particular, to fix the carcass in the position as well as in a predetermined open position.

A second control element is preferably designed as a toothed ring arranged between the first control elements and the central opening with teeth arranged at equal angular distance from each other and directed towards the first control elements.

The teeth and an imaginary central perpendicular of the recesses of the first control elements are aligned in an angular range of 60 to 120°, particularly preferably approximately at right angles to each other.

This makes it possible to control the control disk in a simple manner in such a way that a decoupling of the control disk from the pin caused by pressing the carcass from the initial position against the opening direction is accompanied by a slight rotational movement of the control disk.

After subsequent release of the carcass, the opening movement of the carcass can take place, assisted by the force accumulator, with the pin passing between two adjacent first control elements, thus allowing the carcass to be moved further in the opening direction.

According to an advantageous embodiment variant of the invention, the force accumulator is designed as a torsion spring.

Such torsion springs can be manufactured inexpensively and mounted on the furniture element.

According to a preferred further development, the force accumulator, which is designed as a torsion spring, is fixed with a first end to a bore on the surface of the bottom panel facing away from the carcass.

This enables the force accumulator to be mounted on the bottom panel in a simple and cost-effective manner.

According to a further preferred further development, the force accumulator, which is designed as a torsion spring, is fixed with a second end in a bore in the surface of the guide element facing away from the carcass.

To avoid an undesirable increase in the height of the furniture element, the surface of the bottom panel facing away from the carcass has an indentation in which the mechanism is inserted.

According to a preferred embodiment variant, the guide element is part of a fixing device for vertically fixing the bottom panel to the carcass of the furniture element, which leads to a reduction in the necessary components of the furniture element.

According to a further alternative embodiment variant of the invention, a guide channel is provided in the bottom panel which determines the direction and in which a guide carriage is displaceably mounted. Such a guide carriage serves in particular to further stabilize and further improve the smooth running of such a rotatable furniture element.

The displaceable mounting of such a guide carriage in the guide channel of the bottom panel is also conceivable in principle without a mechanism for opening or closing the carcass with a force accumulator supporting an opening and/or closing movement of the carcass.

In an alternative embodiment variant, this mechanism for opening and/or closing the carcass with a force accumulator supporting an opening and/or closing movement of the carcass is designed as an ejector or push-to-move mechanism with a plunger coupled to the force accumulator, with which the guide carriage can be pushed away from a starting position along the guide channel.

The use of such a push-to-move mechanism makes it possible in particular to design the furniture element without an actuating handle and to initiate the opening movement of the furniture element by pushing it in against the intended opening direction. The use of a push-out mechanism that can be activated in another way is also conceivable.

According to a further preferred embodiment variant, the guide carriage is designed as part of a fixing device for vertical fixing of the bottom panel to the carcass.

According to a preferred further development, this fixing device has a roller bearing arranged on an underside of the guide carriage facing away from the carcass, having at least two rollers arranged one behind the other in the longitudinal direction of the guide channel.

The rollers have circumferential v-shaped grooves into which v-shaped webs project from opposite side walls of the guide channel, which v-shaped webs form running surfaces for the rollers.

The interaction of these rollers arranged one behind the other with the v-shaped webs ensures, on the one hand, reliable vertical securing of the guide carriage.

In addition, the support width of this translational-rotational mechanism is further increased by the multiple rollers arranged one behind the other, so that reliable guidance is ensured even when using heavier furniture elements, especially in a range of masses above 50 kg, without causing the furniture element to tip.

According to a further preferred embodiment variant, a bearing neck projecting into an opening in the support panel is integrally formed on an upper side of the guide carriage facing the carcass of the furniture element in order to rotate the support panel and thus the carcass of the furniture element relative to the bottom panel, and a rolling bearing ring inserted into the opening is fitted onto the bearing neck.

According to a further preferred embodiment variant, a stop is arranged on one end face of the guide carriage, which abuts against the plunger of the ejector or push-to-move mechanism when the guide carriage approaches.

Such an embodiment variant of the guide carriage allows a small number of components of the bearing.

BRIEF DESCRIPTION OF THE DRAWING FIGURES

Figure 2:
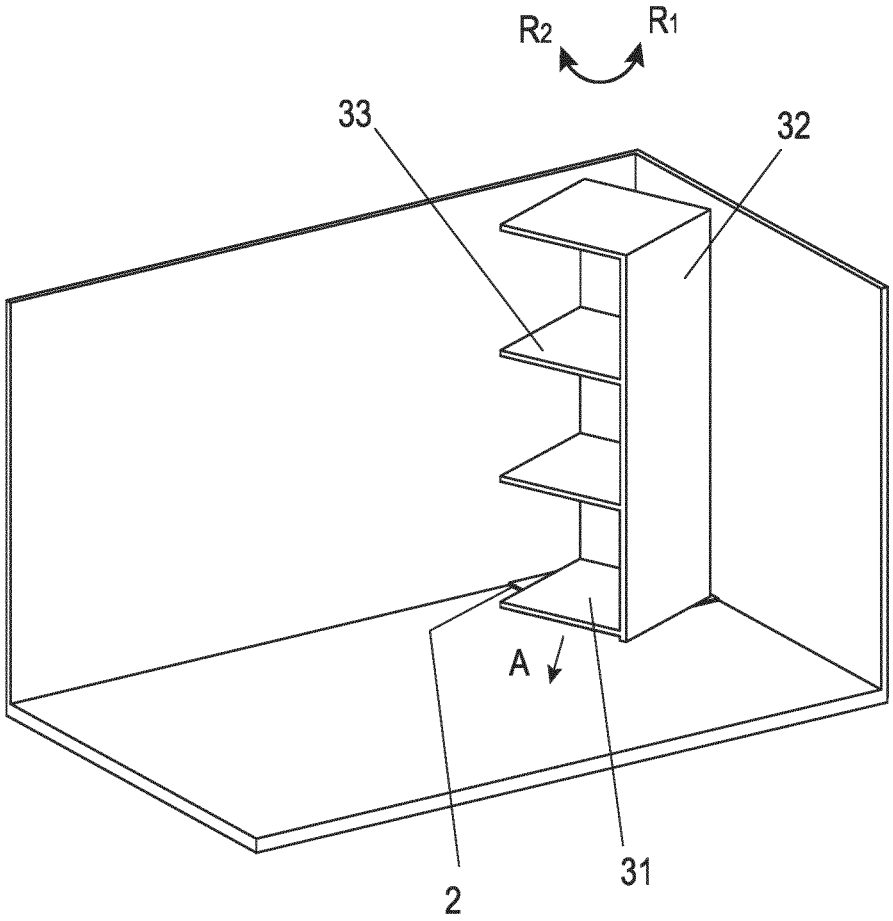
Figure 3:
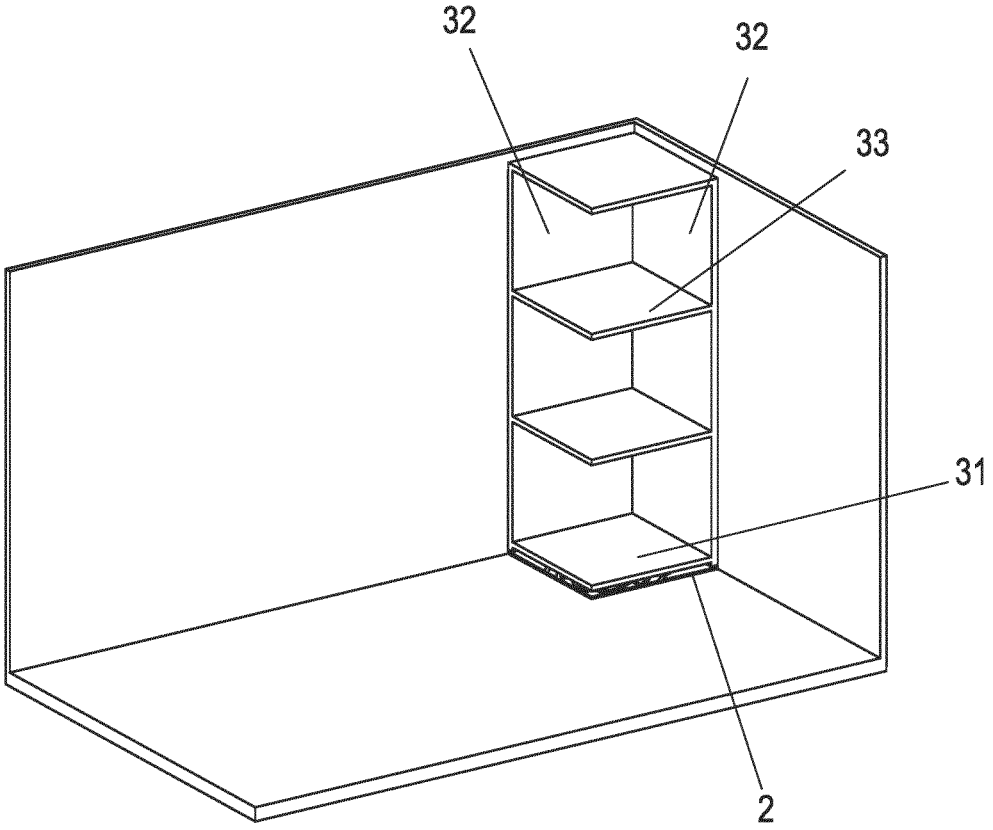
Figure 4:
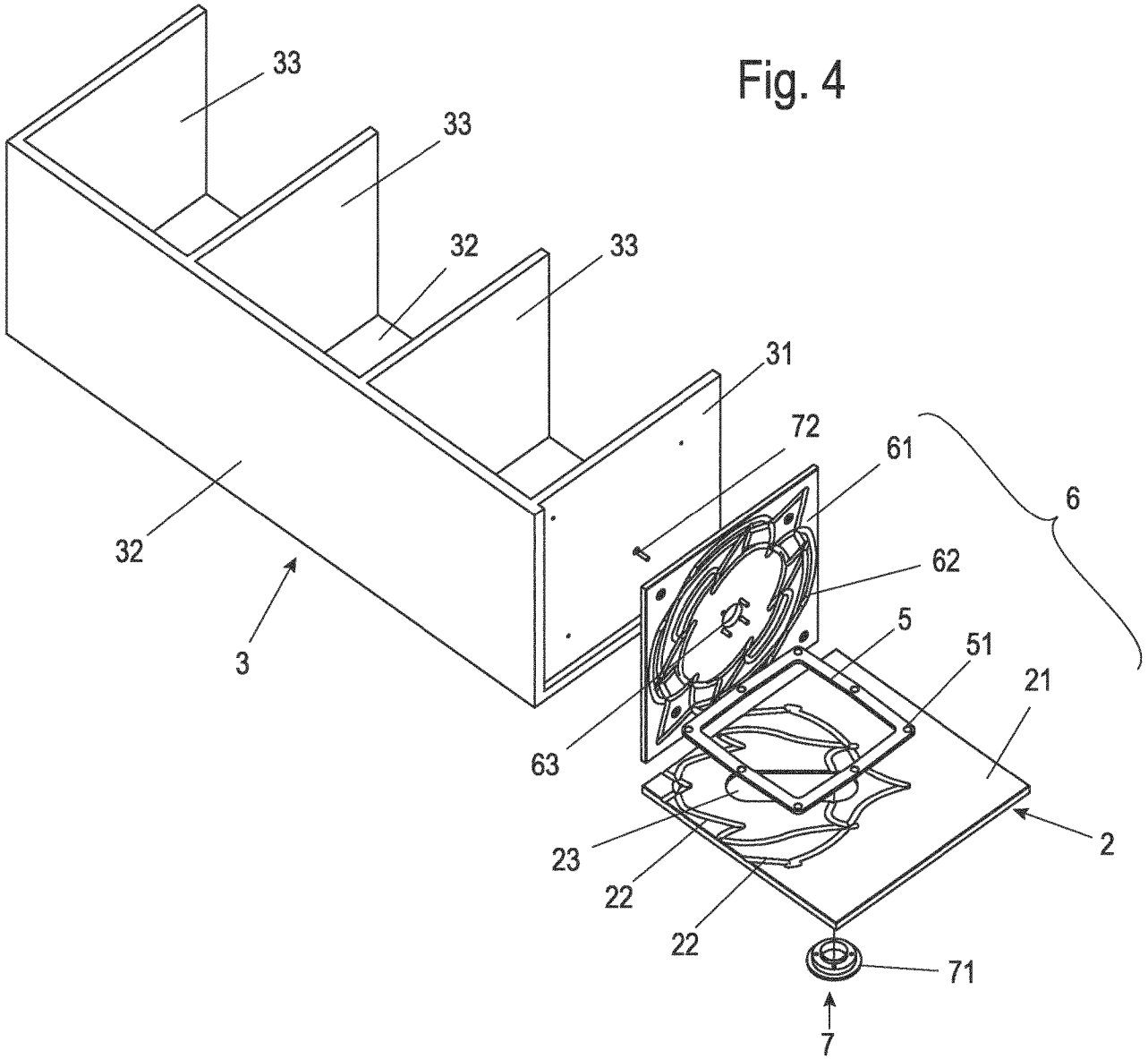
Figure 5:
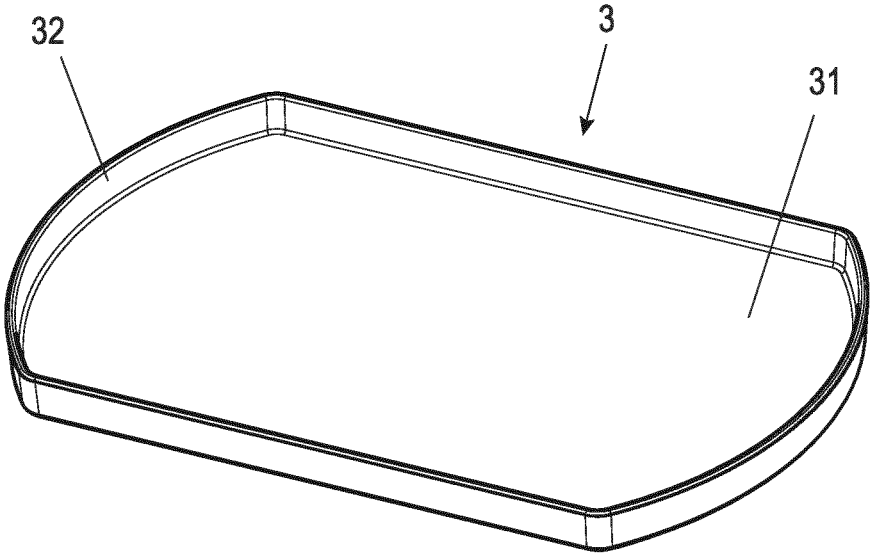
Figure 6:
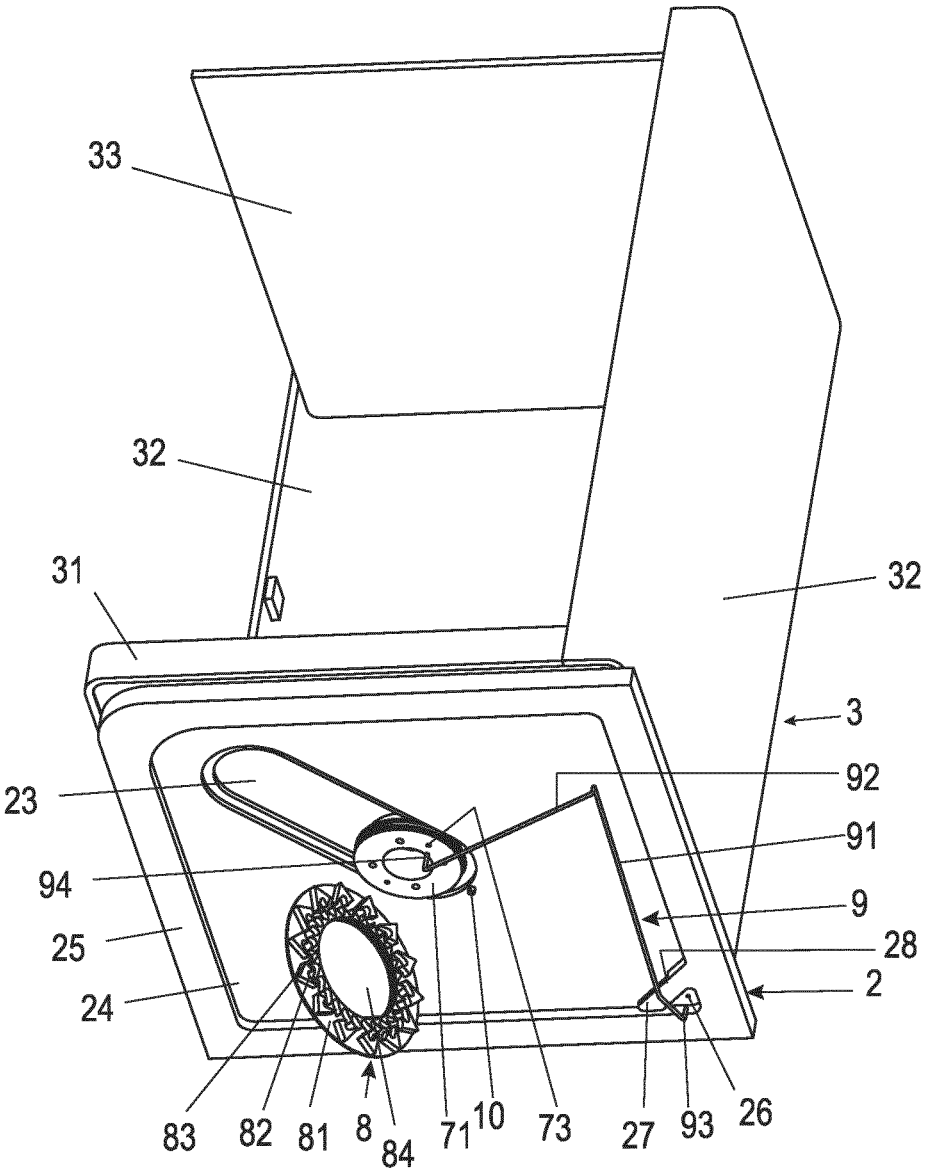
Figure 20:
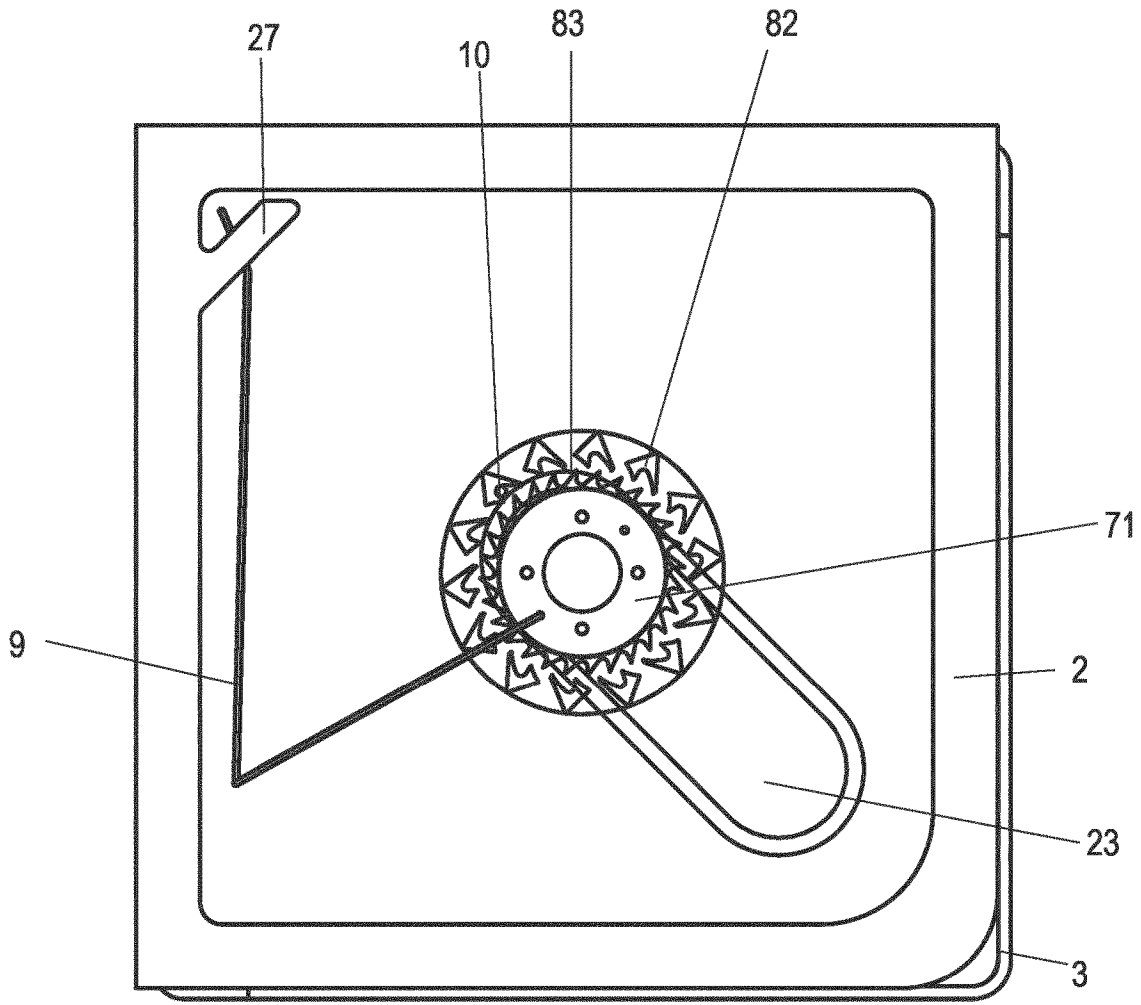
Figure 21:
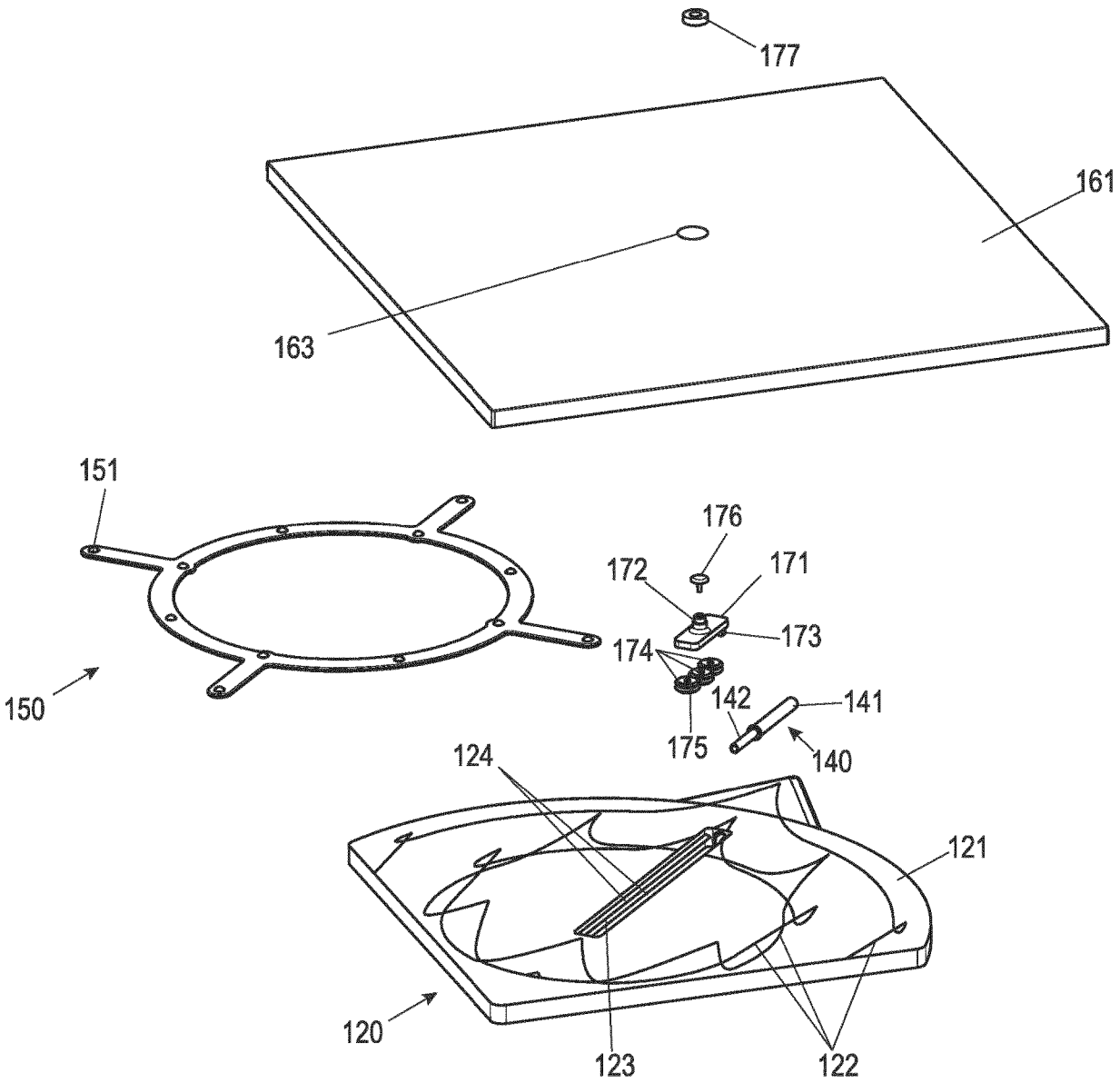
Figure 22:
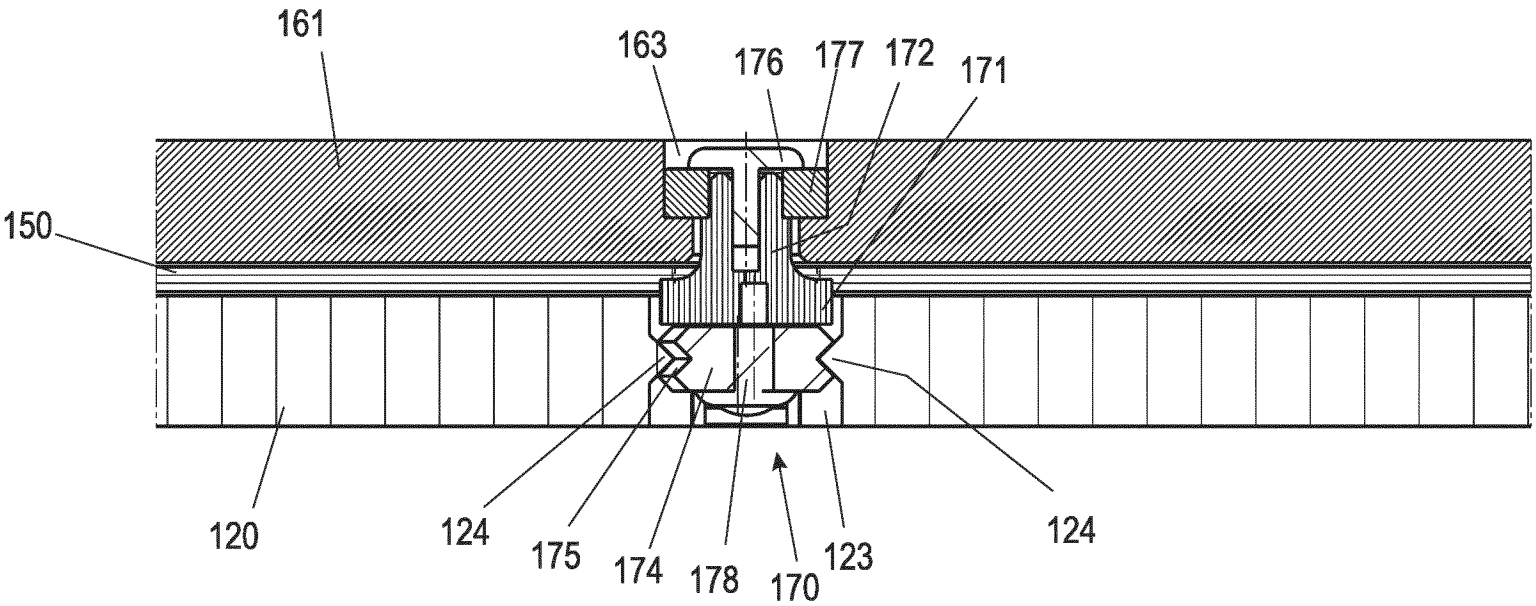
Figure 23:
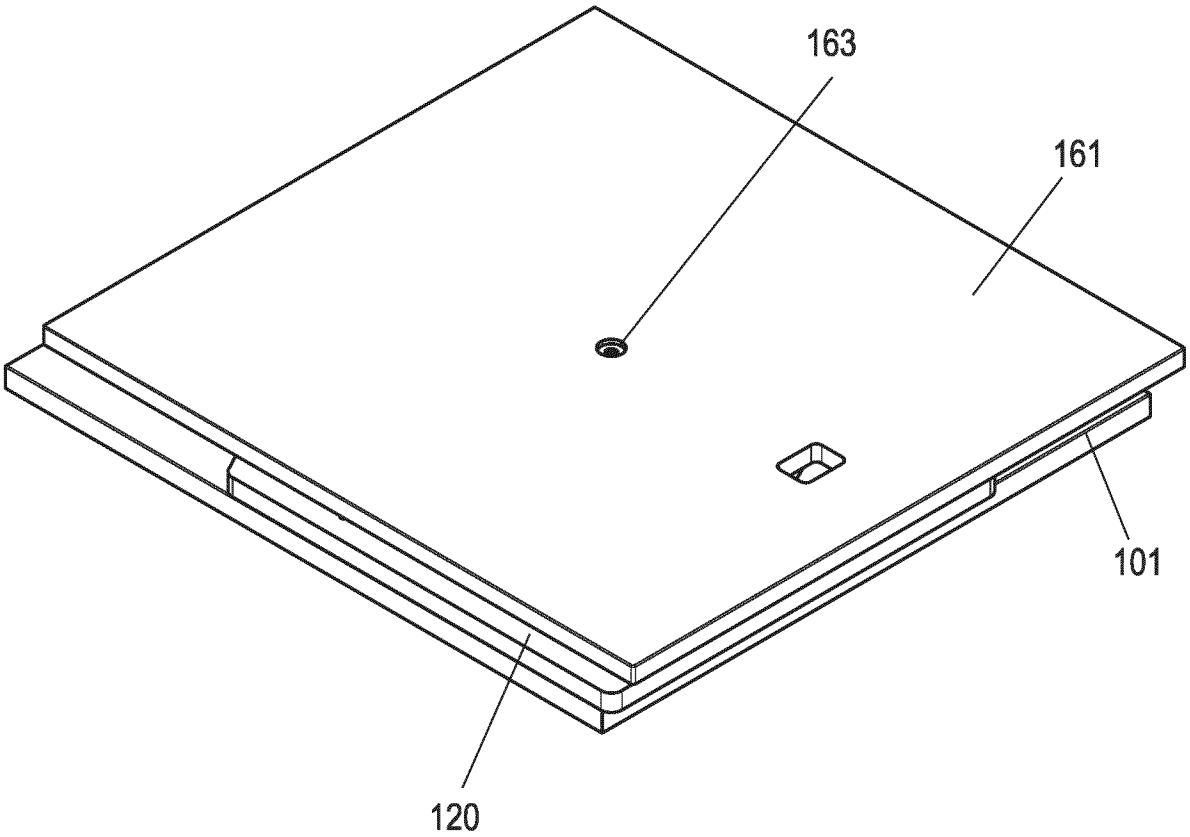
Figure 24:
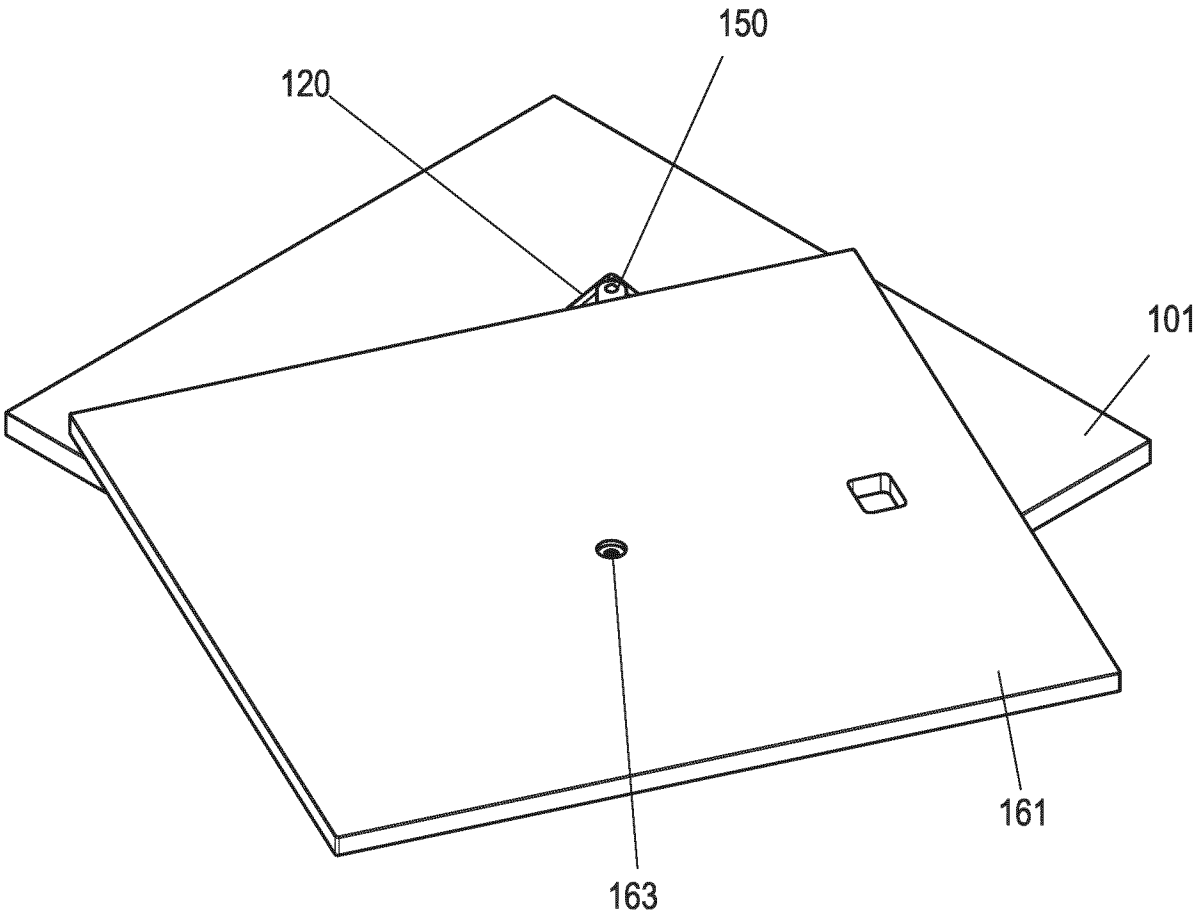
Figure 25:
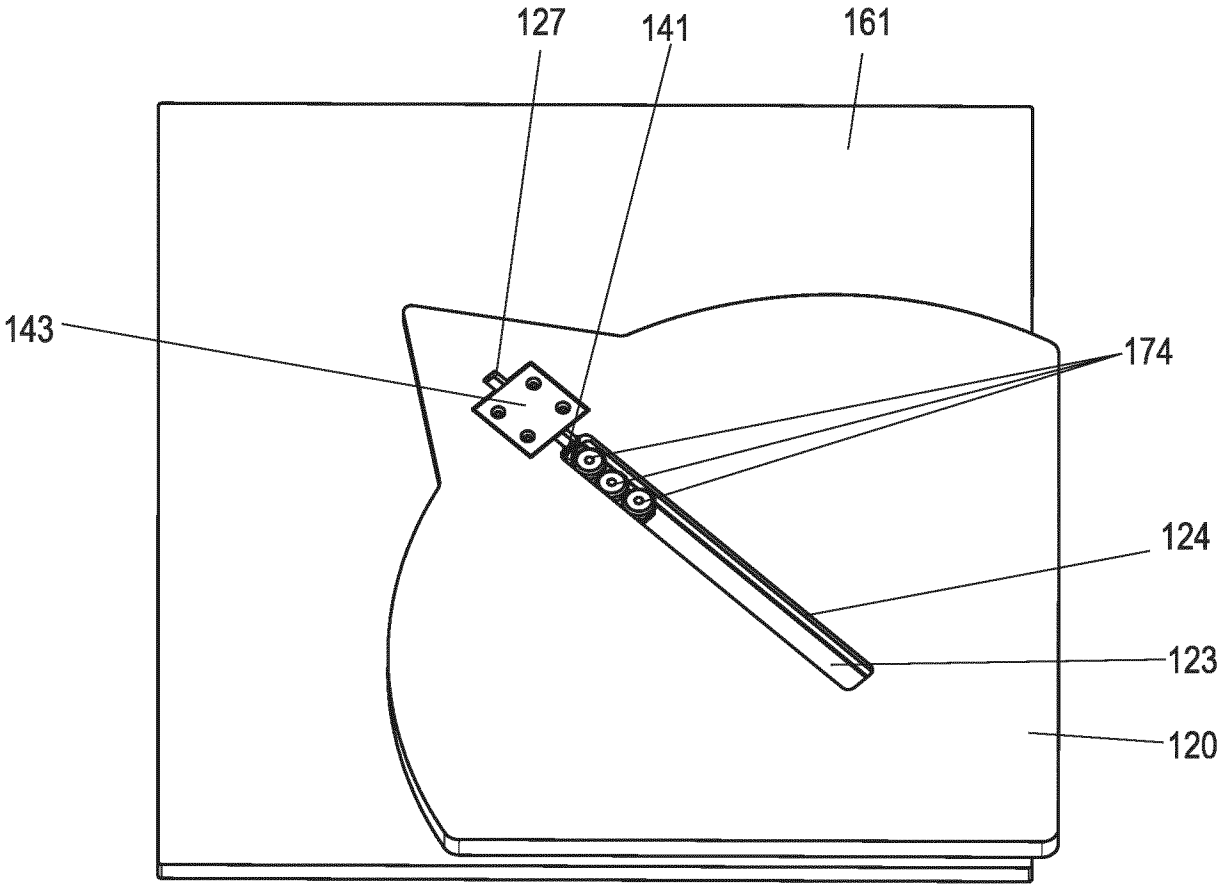
Figure 26:
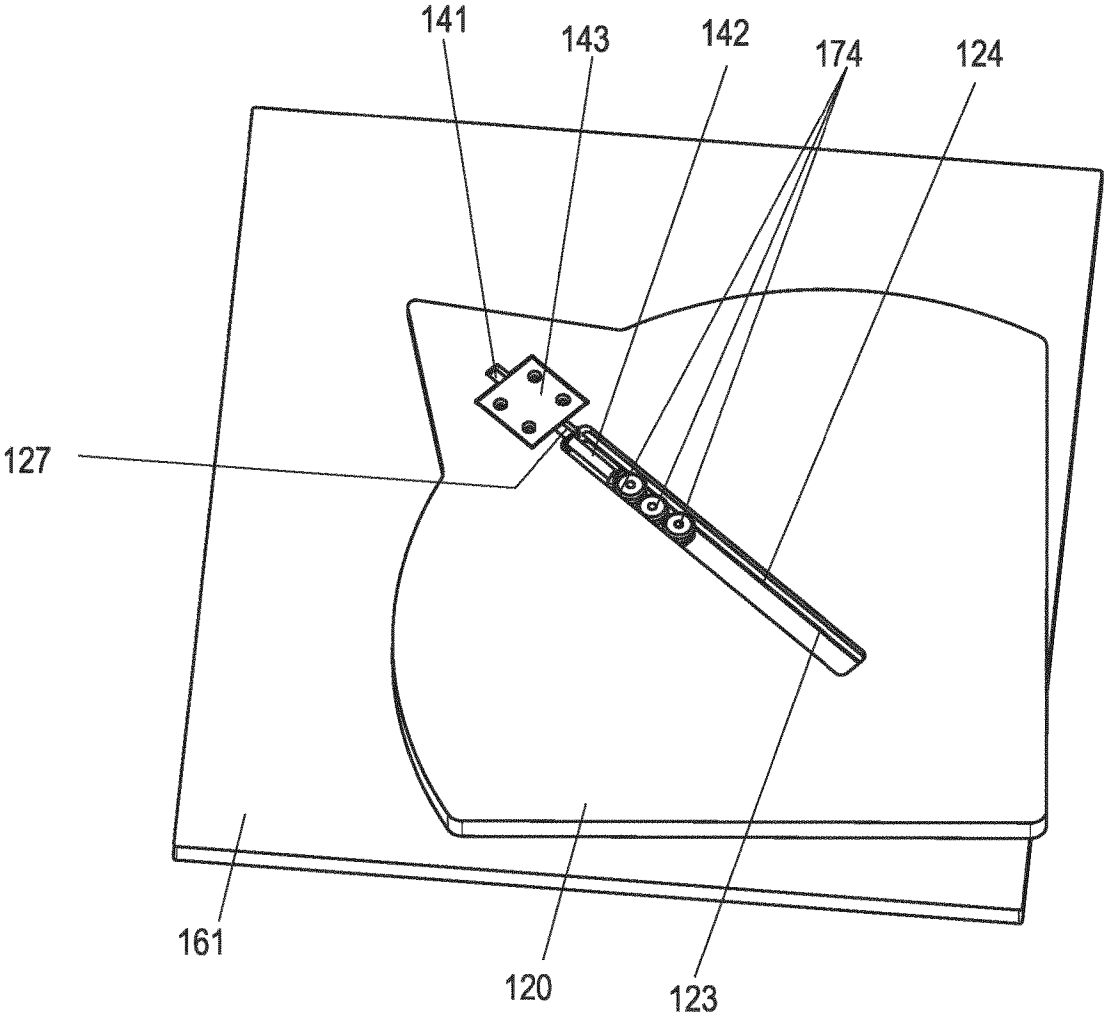
Figure 27:
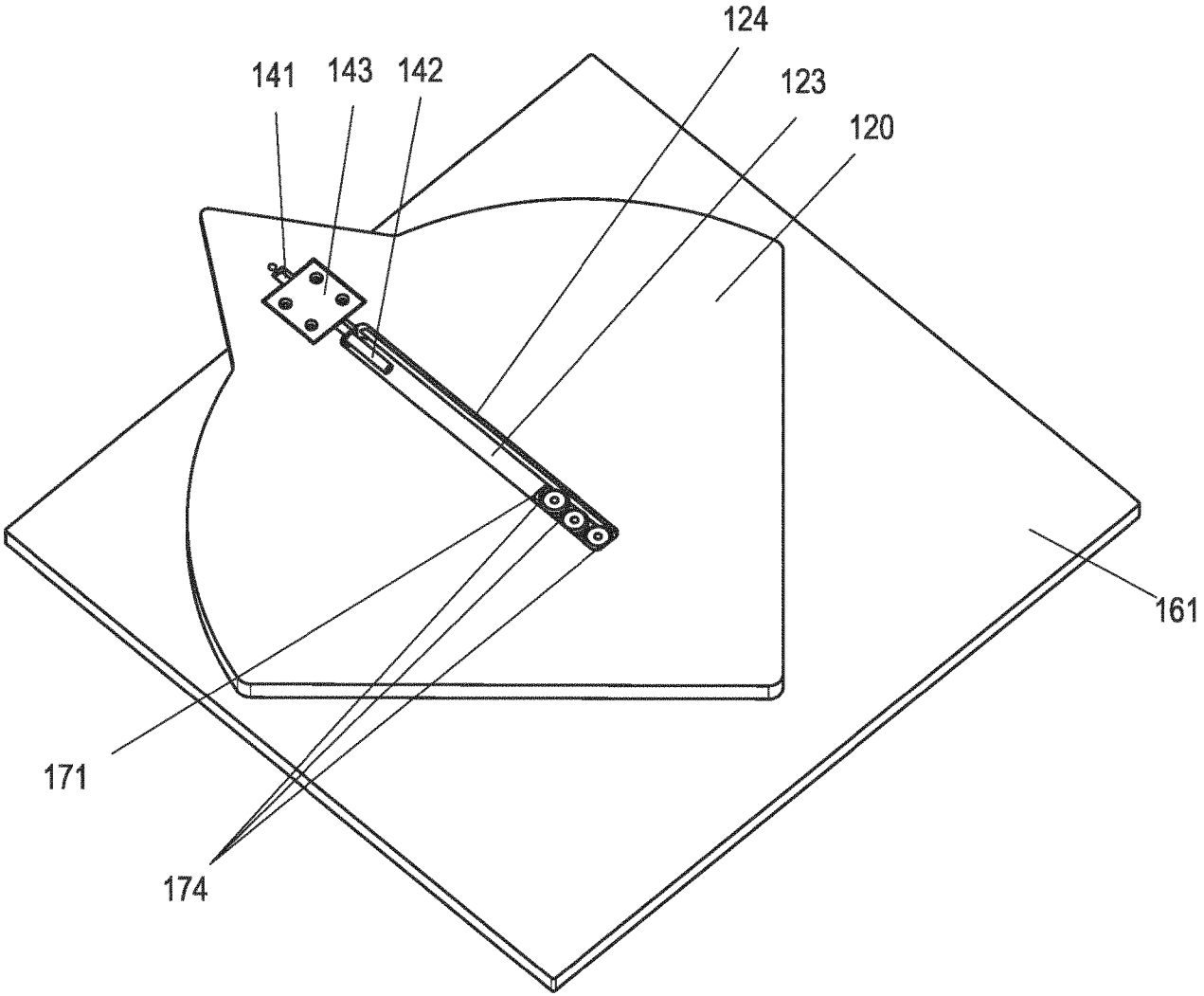
Figure 28:
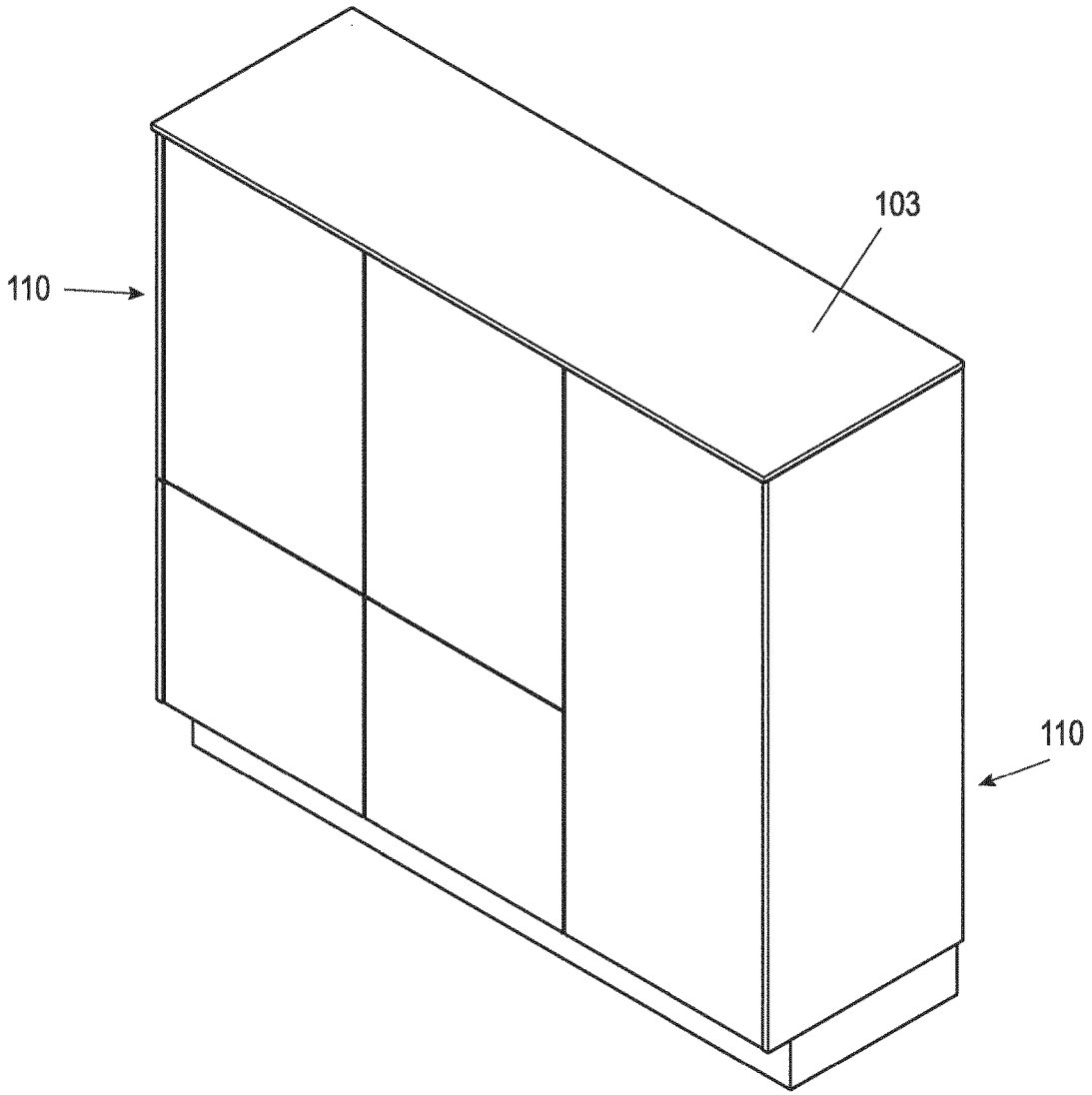
Figure 29:
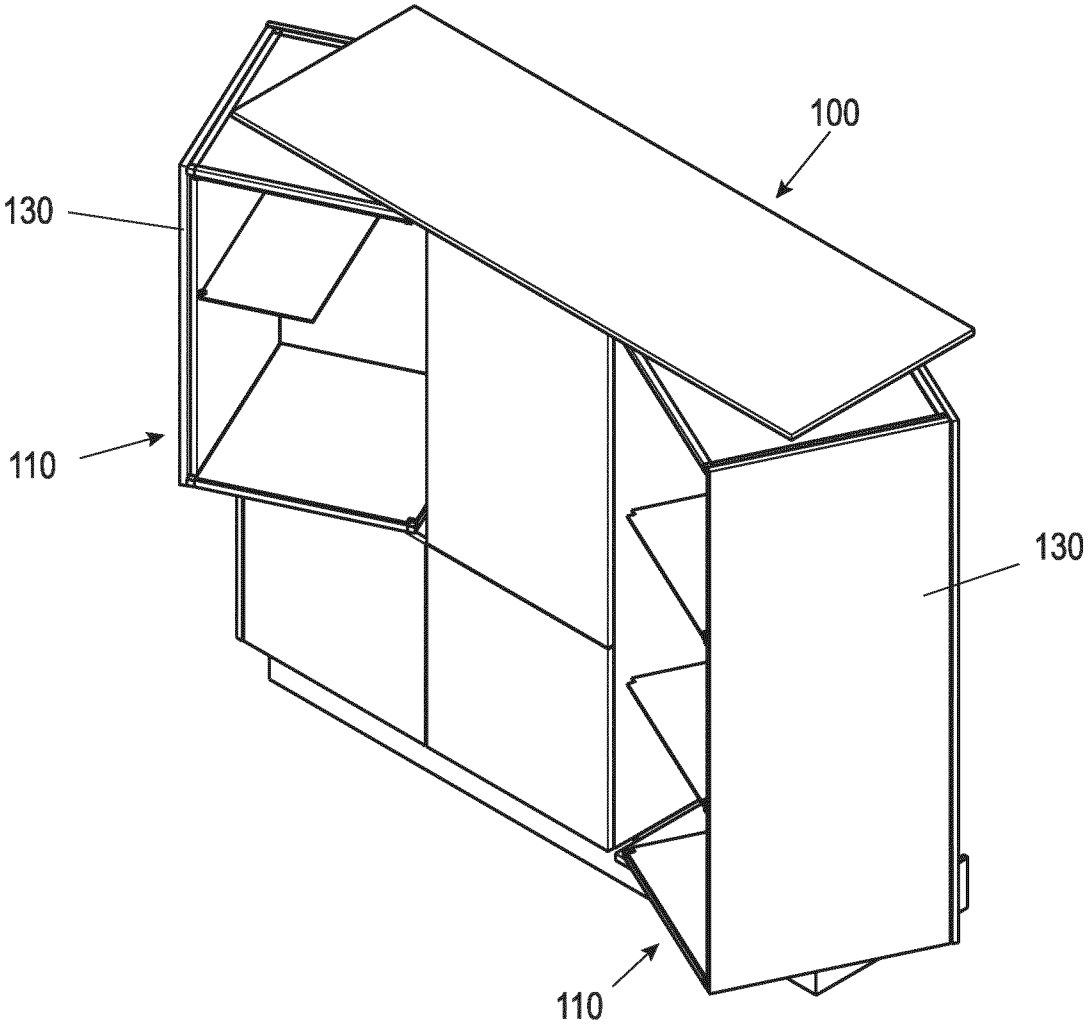
Figure 30:
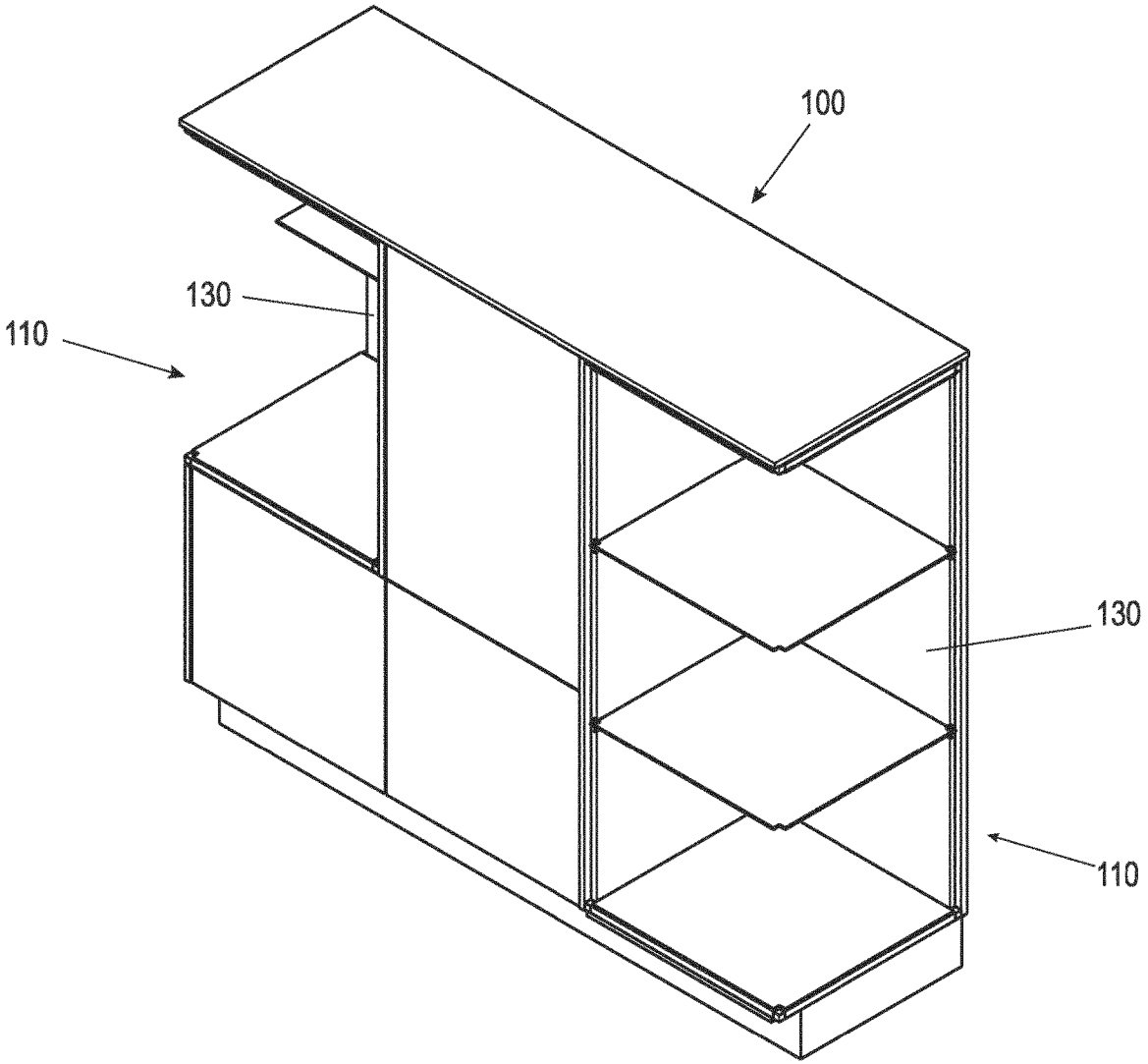

In the following, preferred exemplary embodiments of the invention are explained in more detail with reference to the accompanying drawings, wherein:

FIG. 1 shows a schematic perspective view of an embodiment variant of a furniture element according to the invention, arranged in a corner of a room, FIG. 2 shows a representation of the furniture element corresponding to FIG. 1 in a position rotated out of the corner of the room by an angle, FIG. 3 shows a representation of the furniture element corresponding to FIG. 1 in an open position rotated by 180°, FIG. 4 shows a perspective view of the furniture element shown in FIGS. 1 to 3 with the bottom panel removed to show the running grooves, FIG. 5 shows a schematic perspective view of a further embodiment variant of a furniture element according to the invention, here in the form of a shelf, FIG. 6 shows a schematic perspective exploded view of a furniture element designed as a rack, showing the underside of the bottom panel and the opening mechanism arranged thereon, FIGS. 7 to 20 show respective schematic top views of the underside of the bottom panel to show the sequence of an opening and a closing movement of the carcass relative to the bottom panel, FIG. 21 shows an exploded perspective view of an alternative embodiment variant of a translational-rotational bearing, FIG. 22 shows a sectional view through the translational-rotational bearing shown in FIG. 21, FIG. 23 shows a perspective view of the translational-rotational bearing arranged on a base according to FIGS. 21 and 22 in an initial position, FIG. 24 shows a view corresponding to FIG. 23 in a position rotated counterclockwise by approx. 65° from the initial position, FIG. 25 shows a perspective view of an underside of the translational-rotational bearing according to FIGS. 21 and 22 in the initial position, FIG. 26 shows a view corresponding to FIG. 25 in a position rotated counterclockwise by approx. 5° from the initial position and slightly shifted, FIG. 27 shows a view corresponding to FIG. 25 in the open position, FIG. 28 shows a perspective view of an embodiment variant of a piece of furniture according to the invention having furniture elements in the starting position, FIG. 29 shows a view corresponding to FIG. 28 in a position of the furniture elements rotated counterclockwise by approx, 65° from the initial position, and FIG. 30 shows a view corresponding to FIG. 28 in an opening position of the furniture elements rotated counterclockwise by approx. 180° from the initial position.

DETAILED DESCRIPTION

In the following figure description, terms such as top, bottom, left, right, front, rear, etc. refer exclusively to the exemplary representation and position of the furniture element, the carcass, the bottom panel, the guide element, the pin, the control disk, the control element and the like selected in the respective figures. These terms are not to be understood restrictively, i.e., different working positions or the mirror-symmetrical design or the like can change these references.

In FIGS. 1 to 4, a first variant of a furniture element according to the invention is designated by the reference sign 1. The furniture element 1 is designed here as a rack having a carcass 3 with a square base and three storage compartments with respective shelves 33 and two side walls 32 closing the carcass 3 laterally.

The furniture element 1 further has a bottom panel 2 arranged on the carcass 3.

Support surfaces 21, 31 of the carcass 3 and of the bottom panel 2 facing one another have respective running grooves 22, 62 in which rolling elements 51 are guided, which serve to support the carcass 3 in a translationally and rotationally displaceable manner relative to the bottom panel 2.

FIG. 5 shows an alternative embodiment variant of a furniture element 1 according to the invention, wherein the carcass is designed here as a shelf having a support surface 31 which, in conjunction with a bottom panel 2 not visible here, can be moved in rotation and translation relative to the bottom panel 2 likewise in respective rolling elements guided in running grooves not shown here.

The operation of a corresponding furniture element is described, for example, in DE 10 2017 106 170 A1 or in DE 10 2018 108 977 A1.

This furniture element can also advantageously be equipped with a mechanism for opening and/or closing described below.

As shown in FIG. 4, it is also conceivable to form the running grooves 62 of the carcass 3 in a separate support panel 61 attached to the underside of a first shelf 31.

As shown in FIG. 4, the rolling elements 51 are preferably mounted in a rolling element cage 5, which in the embodiment variant shown here is designed as a square-shaped frame corresponding to the base area of the furniture element 1, having a total of eight rolling elements 51 mounted therein, preferably designed as balls.

In this case, the bottom panel 2 together with the rolling elements 51, the rolling element cage 5 and the support panel 61 or the running grooves 62, if these are provided in the underside of the first shelf 31, together form a translational-rotational bearing 6.

With such a translational-rotational bearing 6, the carcass 3 can be displaced relative to the bottom panel 2, for example, out of a corner of the room 4 in a direction A and essentially simultaneously rotated by turning about a position-variable axis of rotation from the initial position shown in FIG. 1 in a direction of rotation R1 via an intermediate position shown in FIG. 2 into an open position shown in FIG. 3.

The proportions of translation and rotation in the overall movement can vary over the course of the movement.

To enable the translational movement, the bottom panel 2 comprises a guide channel 23 that predetermines the direction A of the translation and in which a guide element 71 is displaceably mounted.

The guide element 71 is preferably part of a fixing device 7 for vertical fixing of the bottom panel 2 to the carcass 3 of the furniture element 1.

In addition to the guide element 71, which is held rotatably and displaceably in the guide channel 23, the fixing device 7 has a screw 72 that is fixed in the underside of the lower shelf 31 and, in the case of the support panel 61 arranged between the bottom panel 2 and the carcass 3, is screwed through a central opening 63 of this support panel 61 into a screw hole provided for this purpose in an upper side of the guide element 71 facing the carcass 3.

The guide channel 23 extends approximately diagonally in the surface of the bottom panel 2, thereby enabling the carcass 3 of the furniture element 1 to be moved out of a corner of the room 4.

In this context, it is of course also possible to have an overall rotated arrangement of the translational-rotational bearing 6 with a guide channel 23 extending parallel to a side edge of the bottom panel 2, for example, by means of which a carcass 3 of a furniture element 1 could be displaced forwards away from a rear wall, for example, perpendicularly to the rear wall, and simultaneously rotated.

As shown in FIG. 6, an opening and/or closing mechanism coupled to the guide element 71 is arranged on a surface of the bottom panel 2 facing away from the carcass 3, with a force accumulator 9 supporting an opening and/or closing movement of the carcass 3.

In the preferred embodiment variant shown here, the mechanism is designed as a so-called push-to-move mechanism with which, by pressing lightly against a front surface or side wall 32 of the carcass 3, the mechanism is unlocked from a basic position shown in FIG. 1 and, after subsequently releasing the carcass 3, the furniture element 1, driven by the force accumulator 9, can be moved from the initial position shown in FIG. 1 to the intermediate position shown in FIG. 2.

In addition to the force accumulator 9, which is fixed to the bottom panel 2 and is preferably in the form of a torsion spring, the mechanism comprises a pin 10, which projects from the surface of the bottom panel 2 facing away from the carcass 3, and a control disk 8, which is rotatably arranged on the guide element 71 and has a plurality of control elements 82, 83 for controlling the movement of the control disk 8 relative to the pin 10.

In addition to the embodiment of the force accumulator 9 as a torsion spring, as shown in FIGS. 6 to 20, other embodiment variants of a force accumulator 9 are also conceivable.

The force accumulator 9 shown in FIGS. 6 to 20, which is designed as a torsion spring with a first leg 91 and a second leg 92 bent at an angle relative to the first leg 91, is fixed, in particular inserted, with a first end 93, which forms the end of the first leg 91, in a bore 26 in the underside of the bottom panel 2 facing away from the carcass 3.

A part of a first leg 91 of the torsion spring 9 directly adjoining this first end is thereby placed under a counter web 27 extending from a frame 25 of the bottom panel into an indentation 24 of the bottom panel in such a way that the first end 93 of the force accumulator cannot disengage from its position inserted into the bore 26.

The counter web 27 is preferably designed thinner in the area of its free end 28 than the foot of this counter web 27, which is close to the frame 25.

The indentation 24 serves to accommodate the mechanism, which is thus invisibly accommodated in the bottom panel 2 and protected from dirt. This results in a low overall height of the bottom panel 2.

The force accumulator 9, designed as a torsion spring, is fixed with a second end 94, which forms the end of the second leg 92, in a bore 73 in the surface of the guide element 71 facing away from the carcass 3.

As shown in FIGS. 6 to 20, the control disk 8 is formed as a ring 81 with a central opening 84 encompassing the guide element 71.

The control elements 82, 83 are arranged on an annular surface facing the bottom panel 2, and in the preferred embodiment variant shown here are integrally formed on the latter.

First control elements 82 are designed as circular catch elements spaced at equal angular distance from each other with a recess 85 open towards the center of the control disk 8, which is bounded by two legs of a respective first control element 82.

An imaginary central perpendicular of the recess 85 is not aligned radially to the center of the opening 84, but at an angle to it.

A second control element 83, as shown in FIGS. 6 to 20, is designed as a toothed ring arranged between the first control element 82 and the central opening 84 with teeth 86 arranged at equal angular distance from each other and directed towards the first control elements 82.

The teeth 86 and an imaginary central perpendicular of the recesses 85 of the first control elements 82 are preferably aligned in an angular range of 60 to 120°, in particular approximately perpendicular to each other.

It is also conceivable to attach feet (not shown) to the surface of the bottom panel 2 facing away from the carcass 3, especially if the bottom panel does not have an indentation 24 shown in FIG. 6 to accommodate the opening mechanism.

FIGS. 7 to 20 now describe an exemplary opening process of a furniture element 1 designed as a rack.

Figure 7:
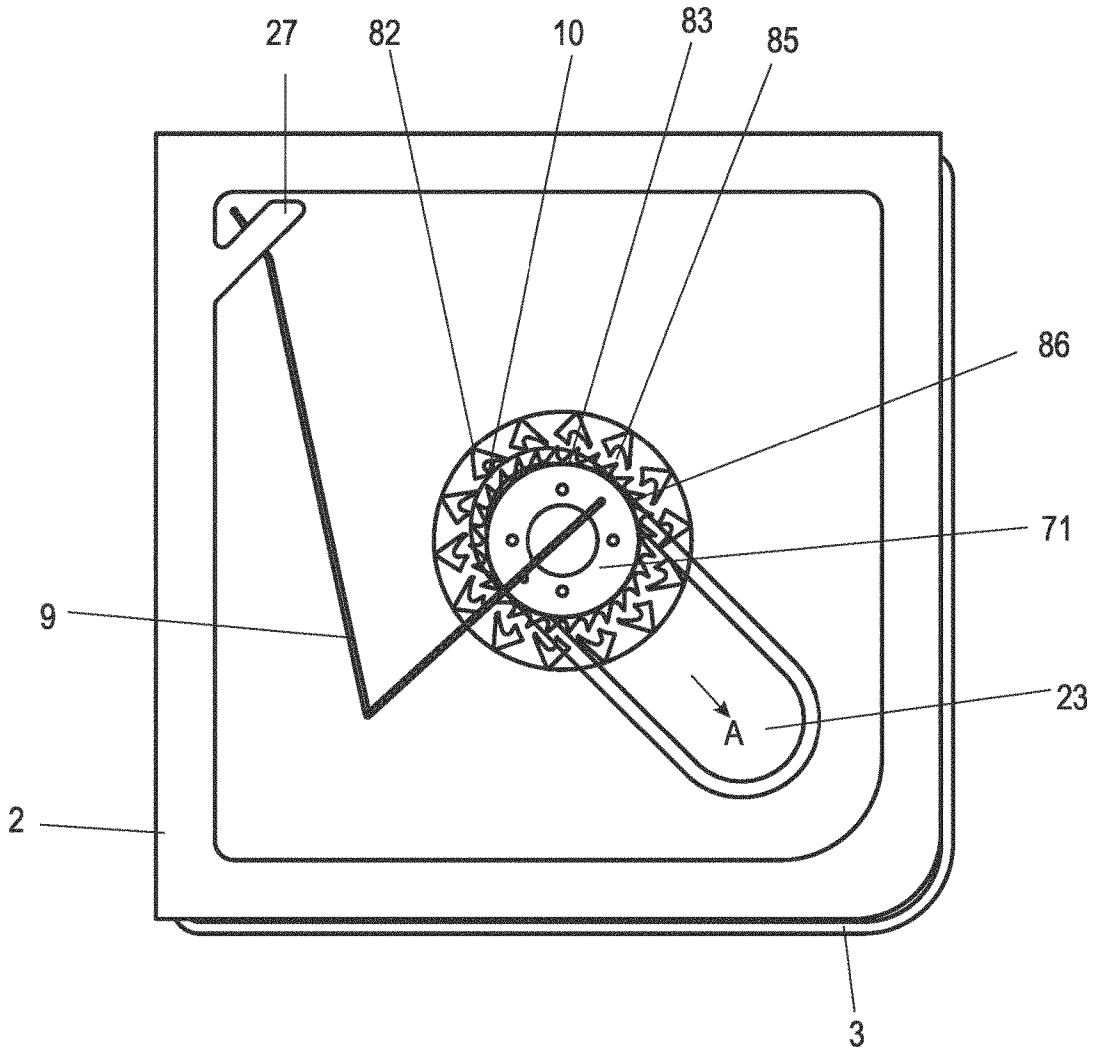

In this regard, FIG. 7 shows an initial position of the carcass 3 of the furniture element 1 shown in FIG. 1. As shown here, the control disk 8 is positioned such that one of the first control elements 82 accommodates the pin 10 in its recess 85.

By coupling the control disk 8 to the guide element 71, a translational movement of the guide element 71 together with the carcass 3 in direction A, shown in FIG. 2, is thereby blocked.

Figure 8:
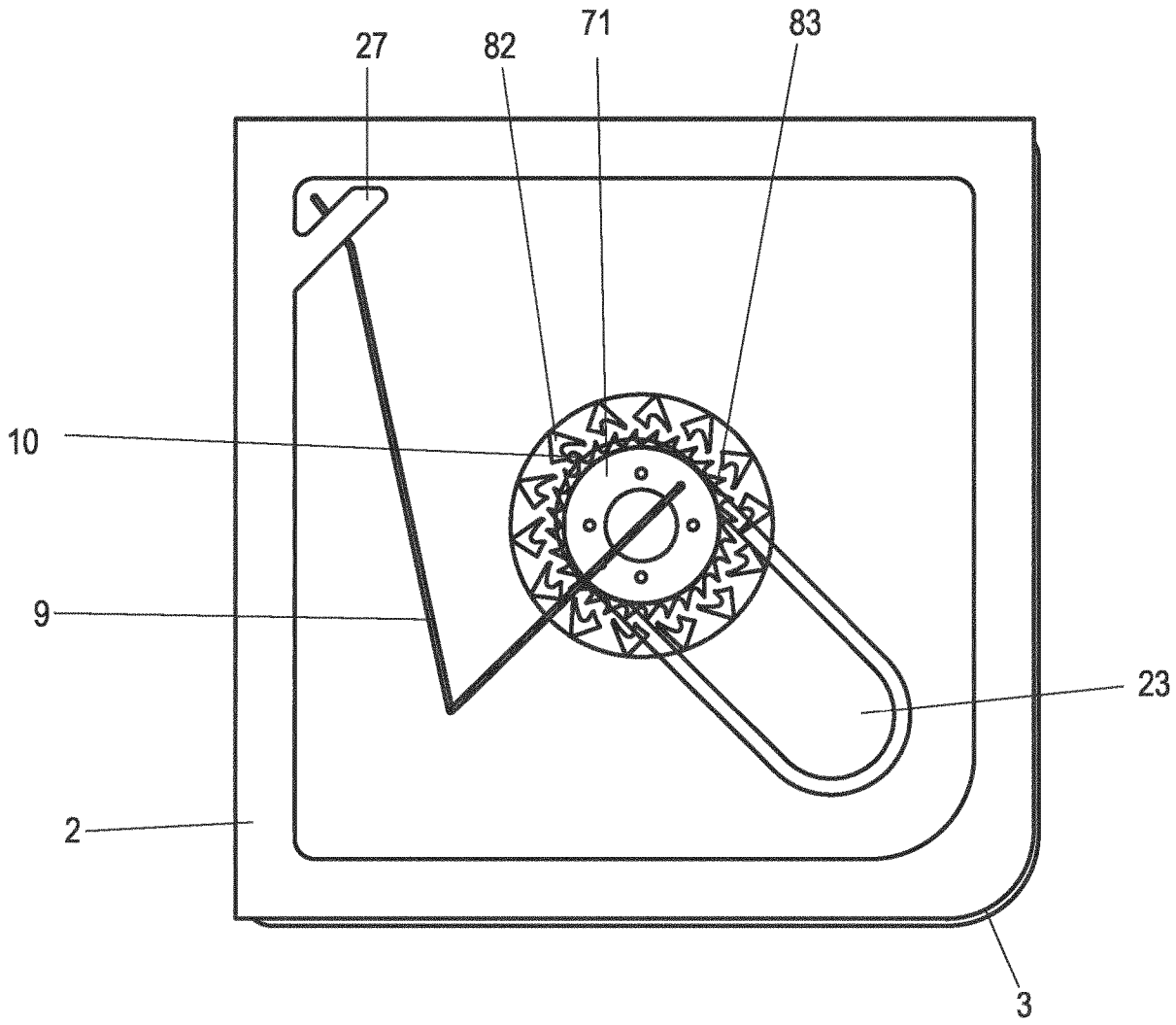

In the position shown in FIG. 8, a user has pressed the carcass 3 slightly in the opposite direction to the direction A. The carcass 3 is then pressed in the opposite direction.

In this case, the guide element 71 is pressed together with the control disk 8 in a direction opposite to the direction A, so that the one first control element 82 is moved away from the pin 10, so that in this position the pin 10 is positioned between the first control element 82 and the second control element 83 formed as a toothed ring.

Figure 9:
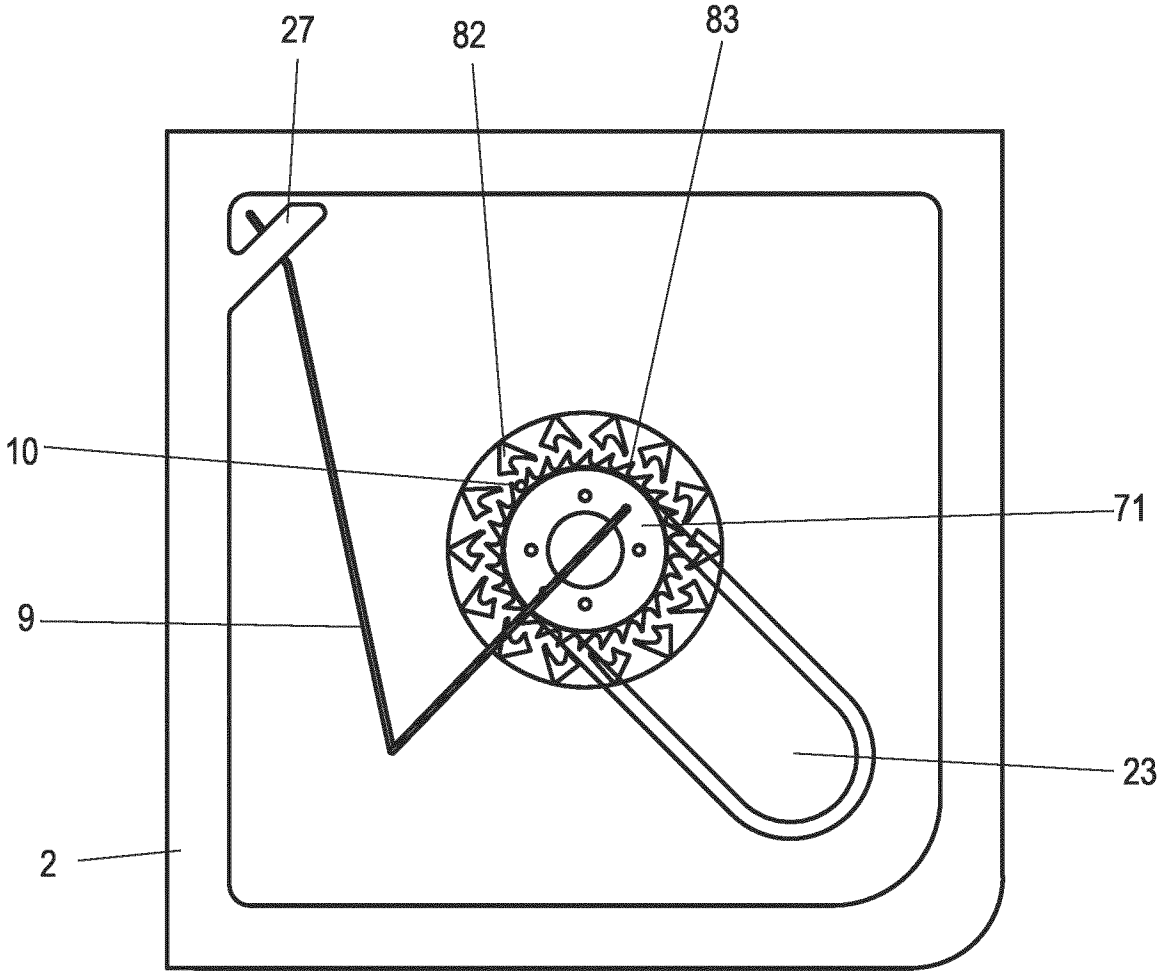

When the carcass 3 is pressed further into the limit switching position, shown in FIG. 9, the second control element 83 is pressed into engagement with the pin 10 in such a way that the pin 10 is located between two teeth 86 of the second control element 83. Further pressing of the carcass 3 is thus prevented.

The force accumulator 9, which is designed as a torsion spring, is in its maximum tensioned position.

The user can then release the carcass 3. As a result of this removal of pressure by the user, the force accumulator 9 in the form of a torsion spring acts and presses the guide element 71 together with the control disk 8 along the guide channel 23 in the direction A. This causes the carcass 3 to move into the intermediate position shown in FIG. 2.

In the process, a side edge of one of the first control elements 82 abuts against the pin 10, causing a slight rotation of the control disk 8.

Figure 10:
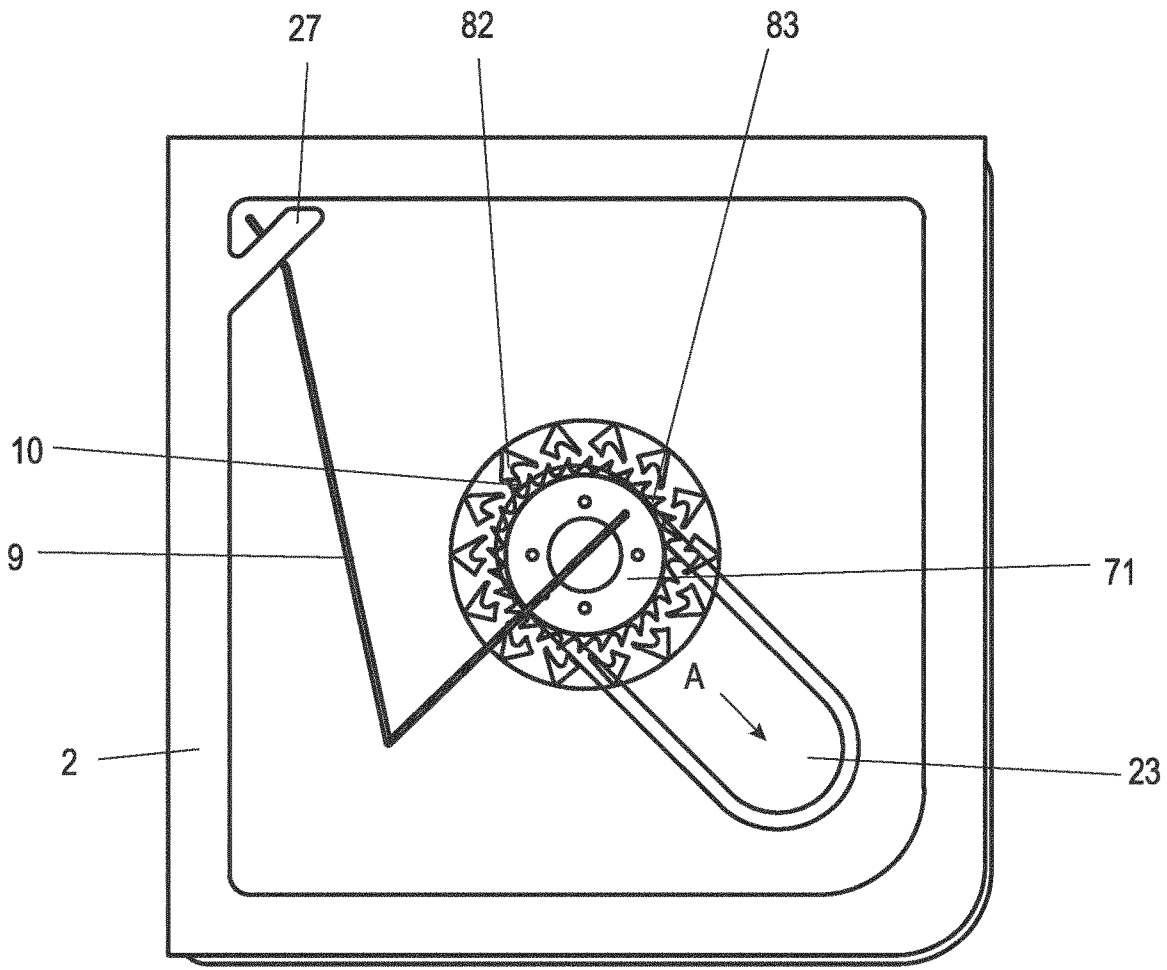
Figure 11:
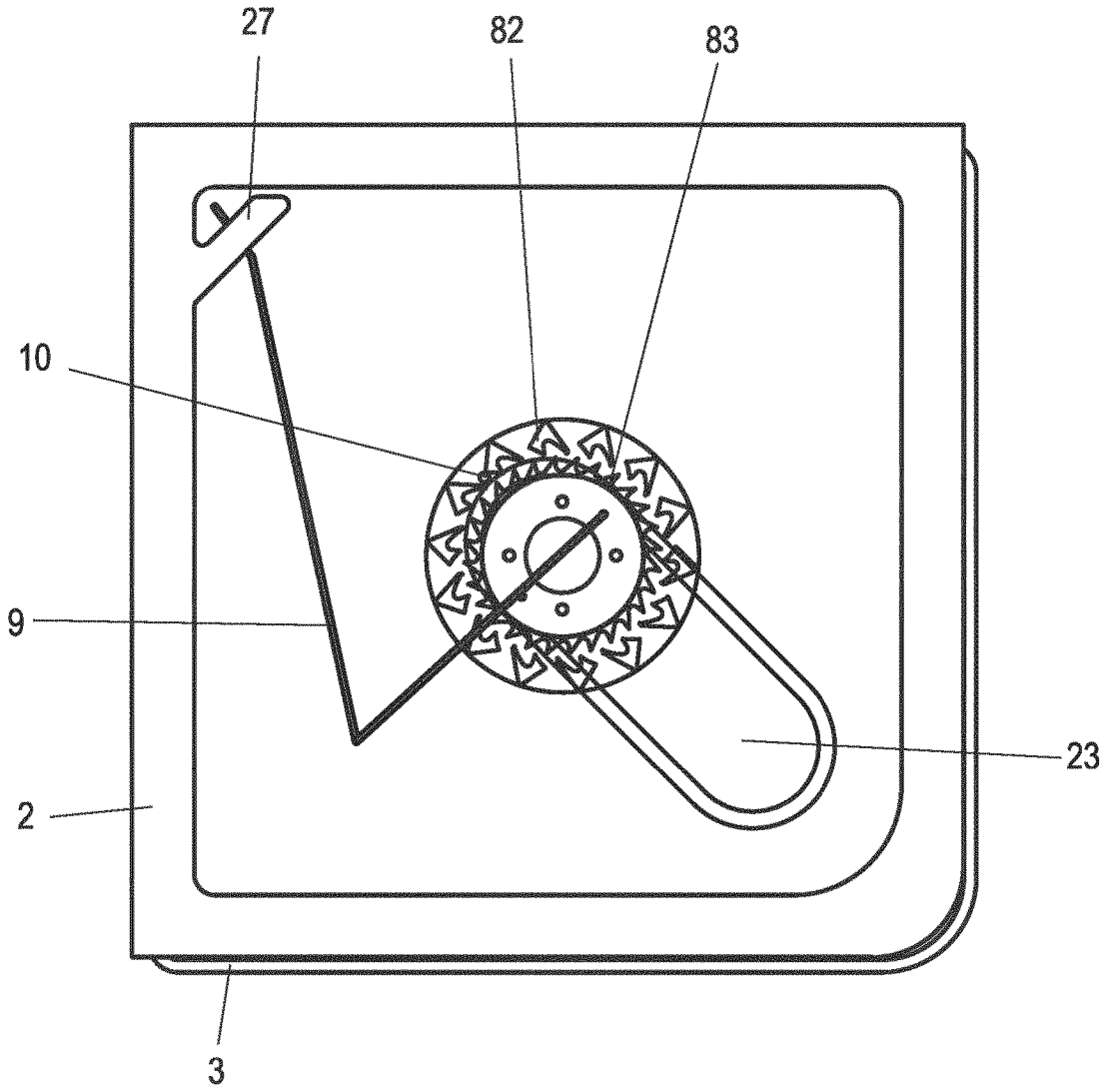

The first control element 82 slides along the pin 10 during further movement with slight rotation of the control disk 8, as shown it FIGS. 10 and 11.

After passing the first control element 82, the pin 10 disengages from the mechanism, thereby releasing the carcass for translational-rotational movement to the intermediate position shown in FIG. 2.

Figure 12:
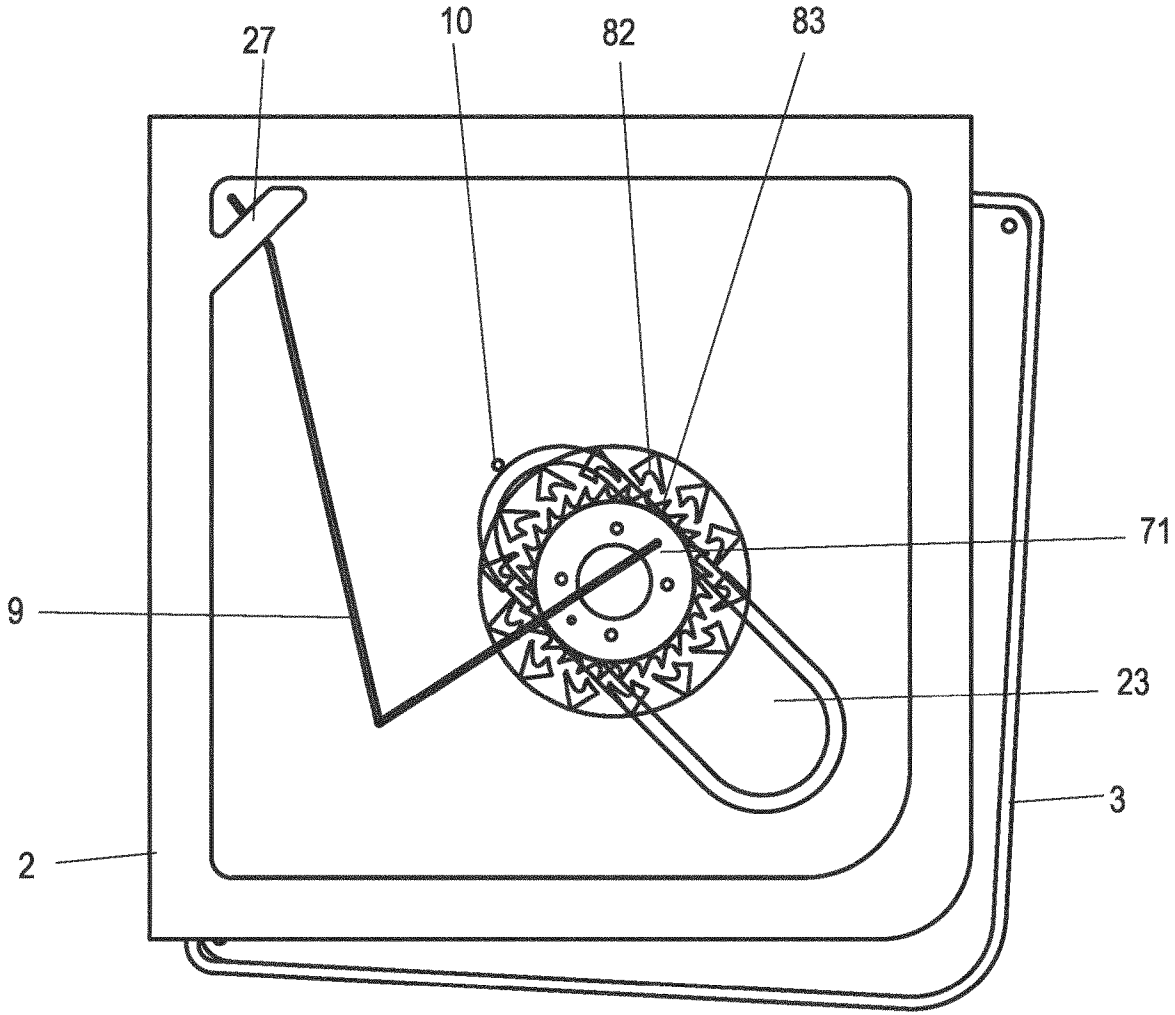

The release position is shown in FIG. 12.

Figure 13:
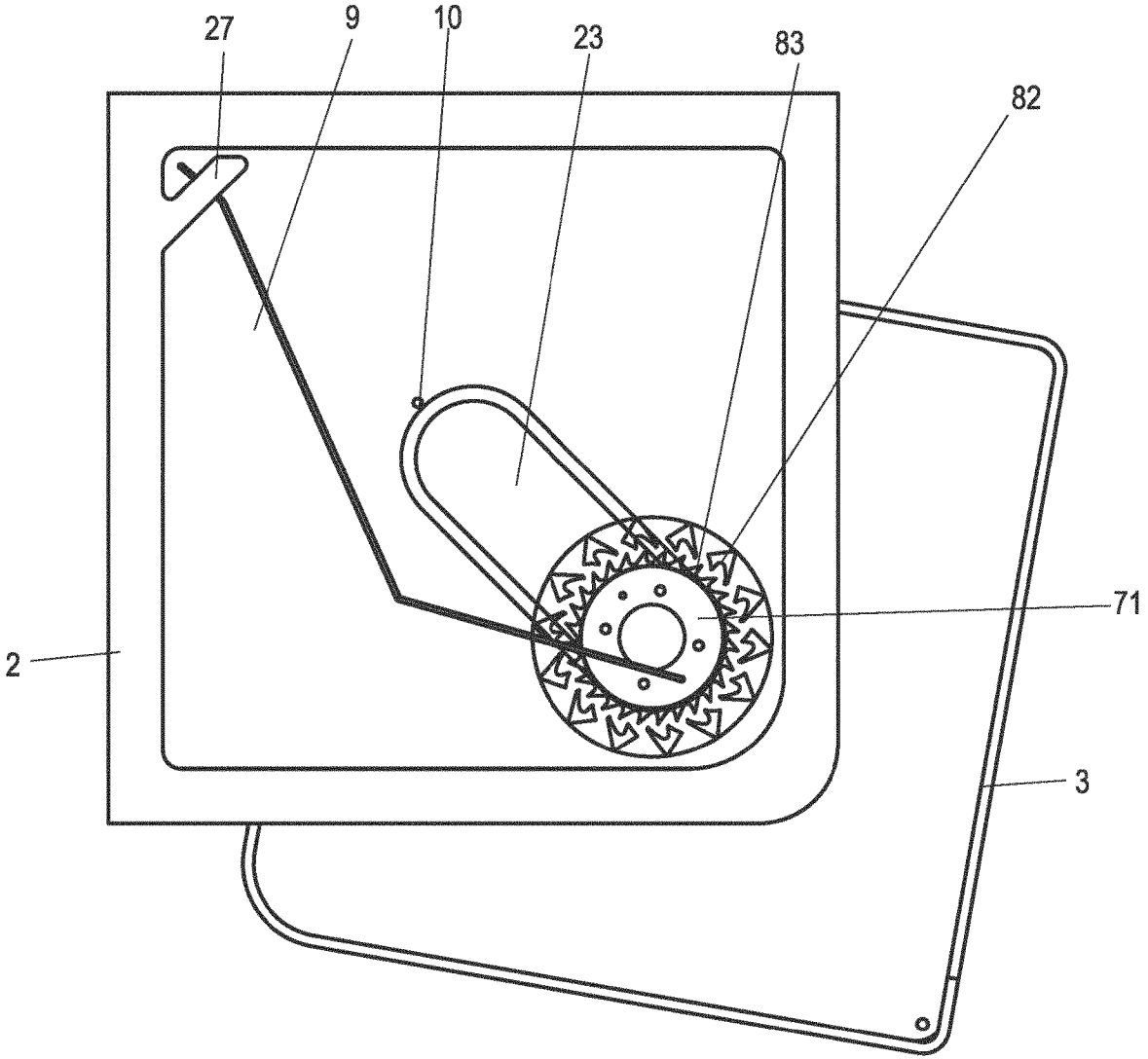

FIG. 13 shows the position of the bottom panel 2 in the it position of the carcass 3 shown in FIG. 2. The force accumulator 9, which is designed as a torsion spring, is in its minimum tensioned position.

Figure 14:
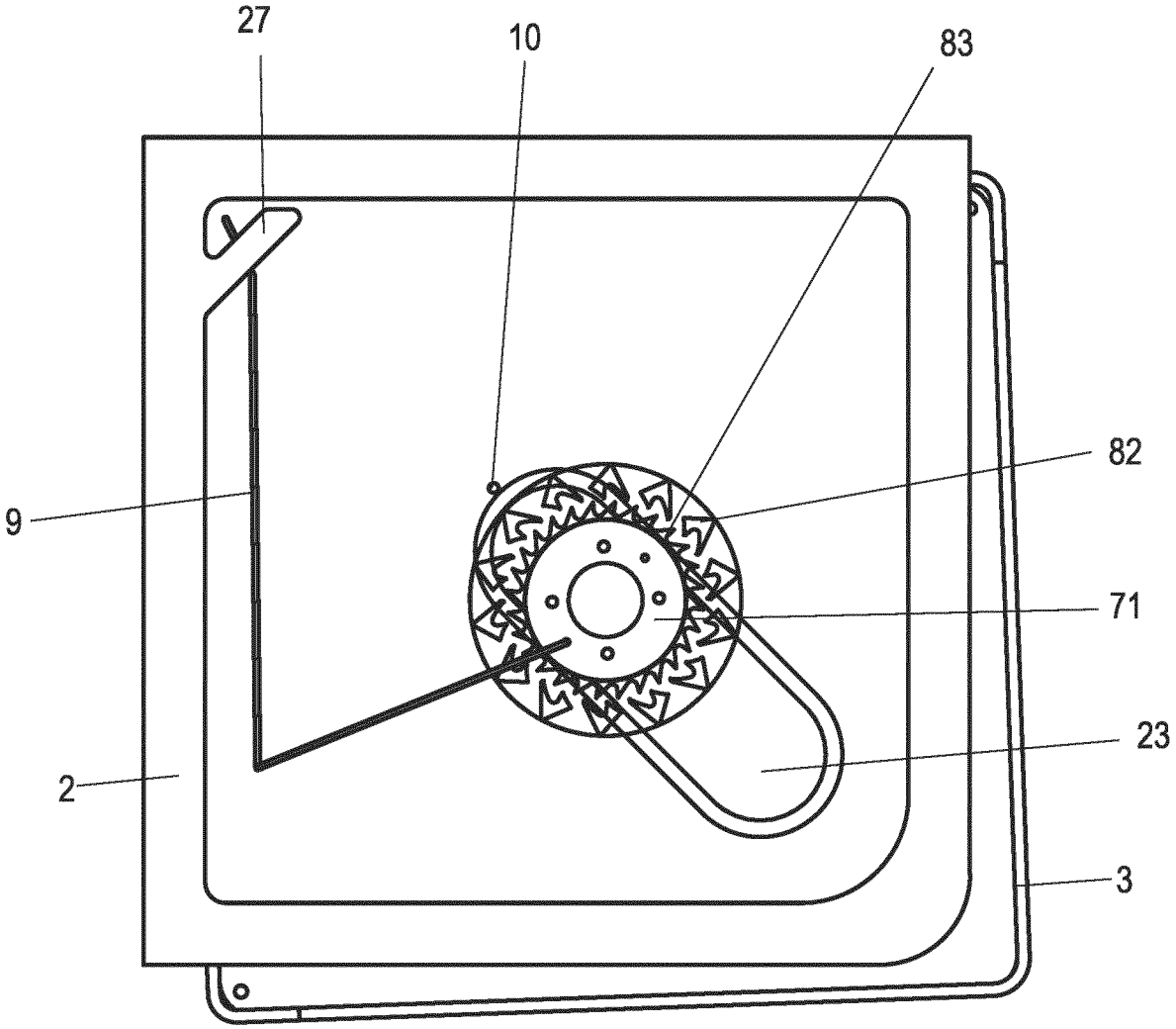
Figure 15:
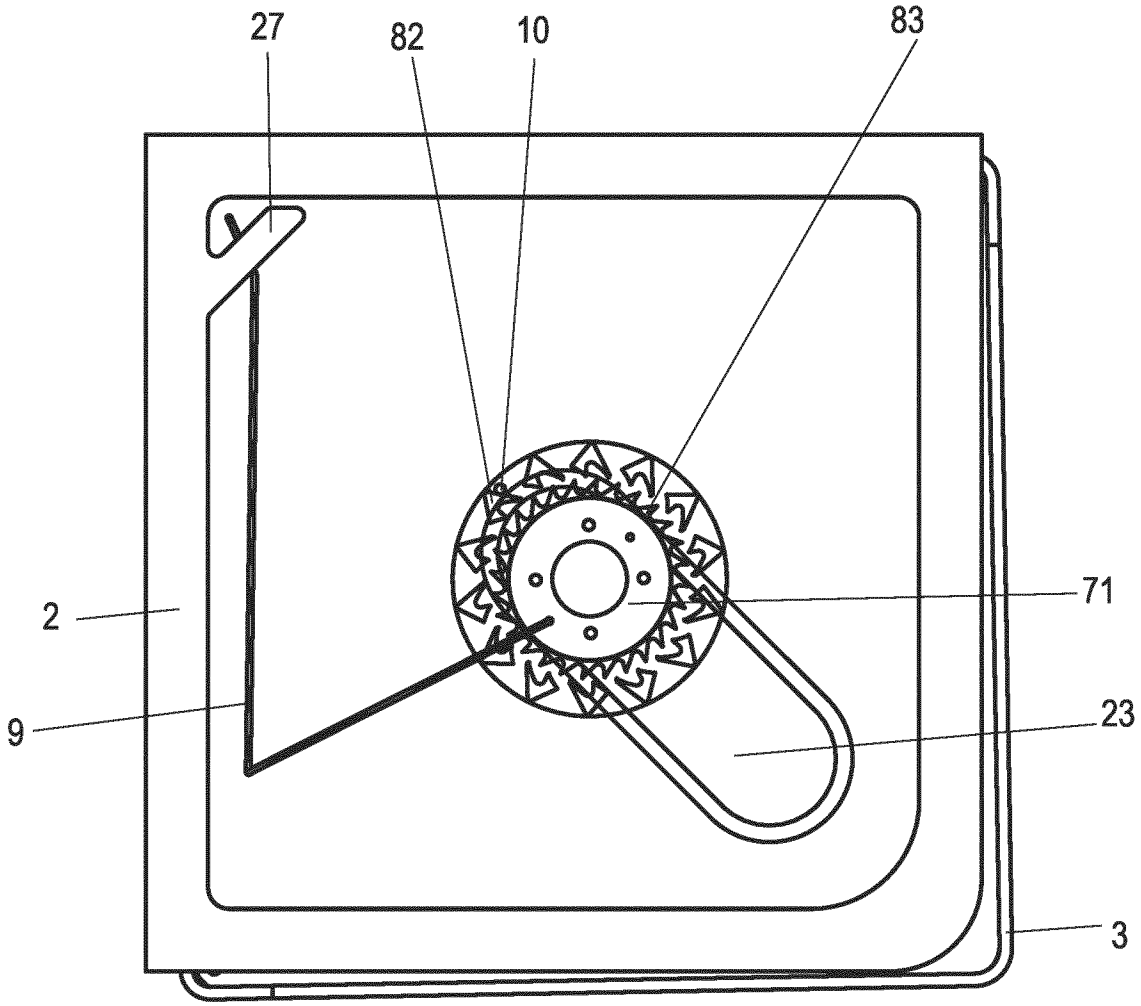

To fully open the carcass 3 from the intermediate position shown in FIG. 2 to the open position shown it FIG. 3, the translational-rotational movement of the carcass 3 is first performed again until the pin 10 moves past the intermediate position shown in FIG. 14, in which the pin 10 is still out of engagement with the mechanism, to the position shown in FIG. 15.

In this process, an outer edge of one of the first control elements 82 abuts the pin 10, causing the control disk 8 to rotate or align.

Figure 16:
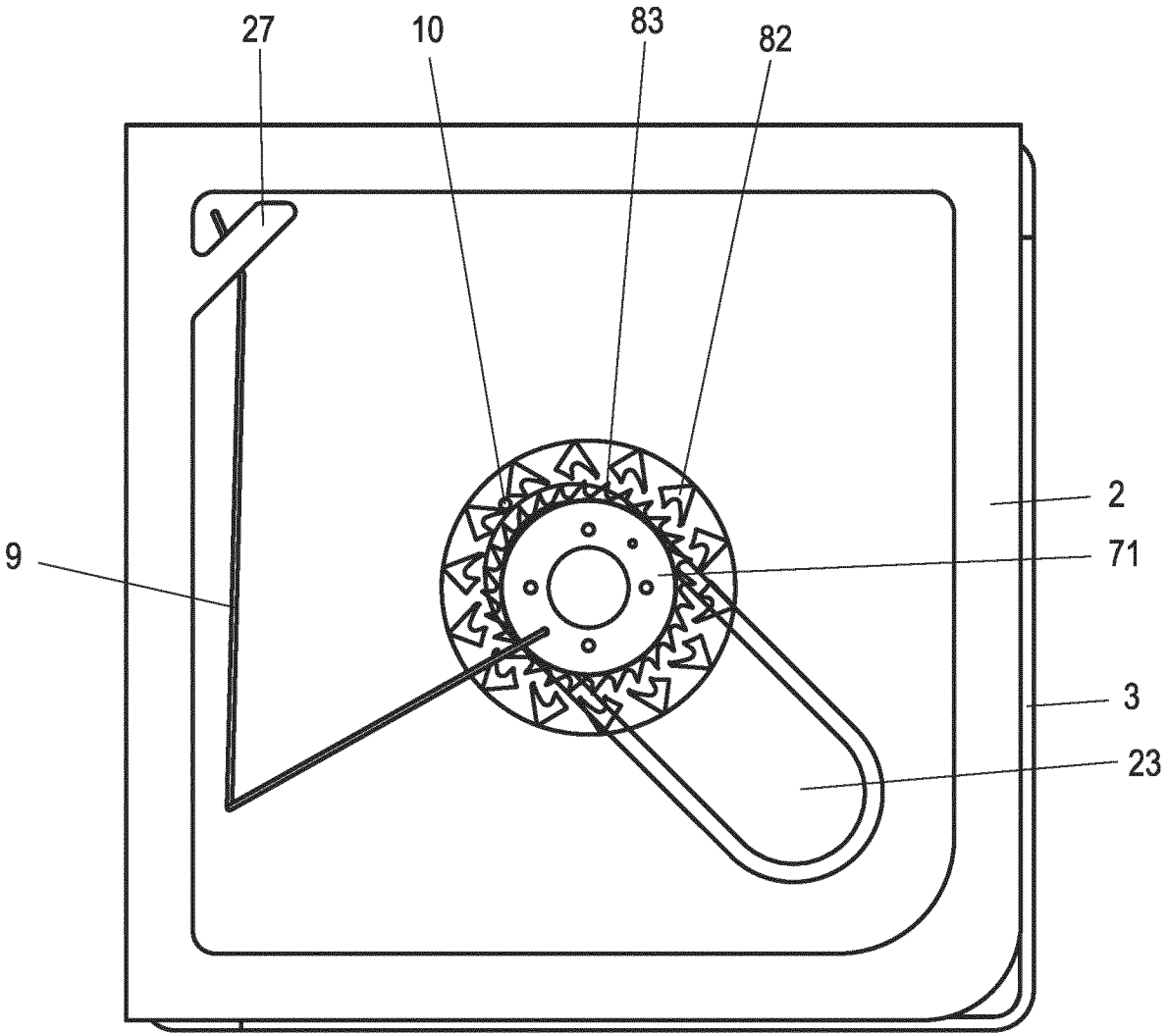

In the representation shown in FIG. 16, the carcass 3 and the control disk are in a position where the pin 10 can slide between two adjacent first control elements 82 in a direction opposite to the direction A.

In this position, the force accumulator 9 is unleaded, so that for the further movement of the carcass 3 into the open position, the user must again press against the carcass 3 against the direction A.

Figure 17:
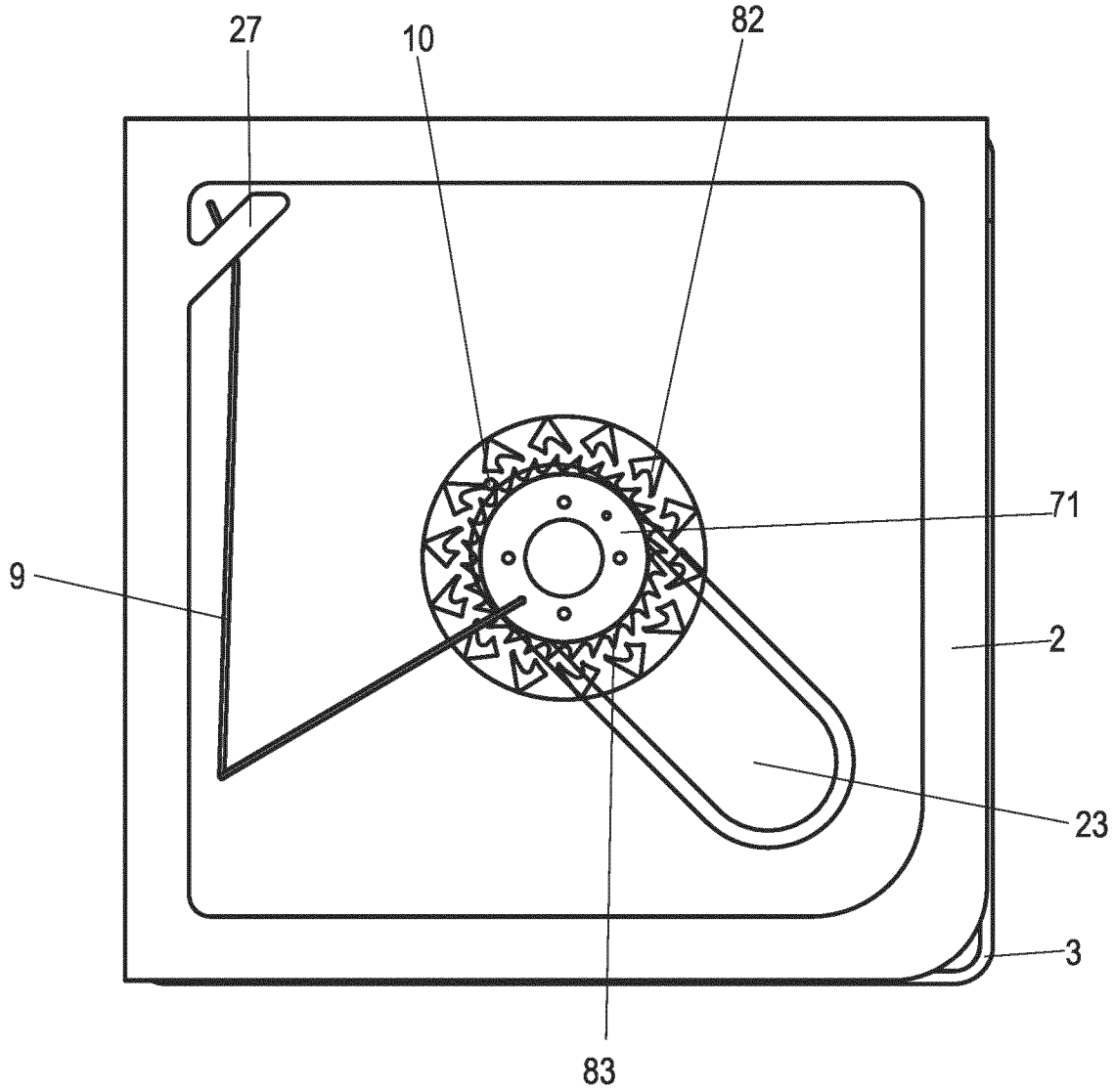

By pressing against the carcass 3 against the direction A, the pin 10 again gets between two teeth 86 of the second control element 83 when the control disk 8 is pushed further, as shown in FIG. 17.

The user feels this by the fact that no further movement of the carcass takes place when further pressure is applied, since this is blocked by the contact of the pin 10 with the second control element 83.

Figure 18:
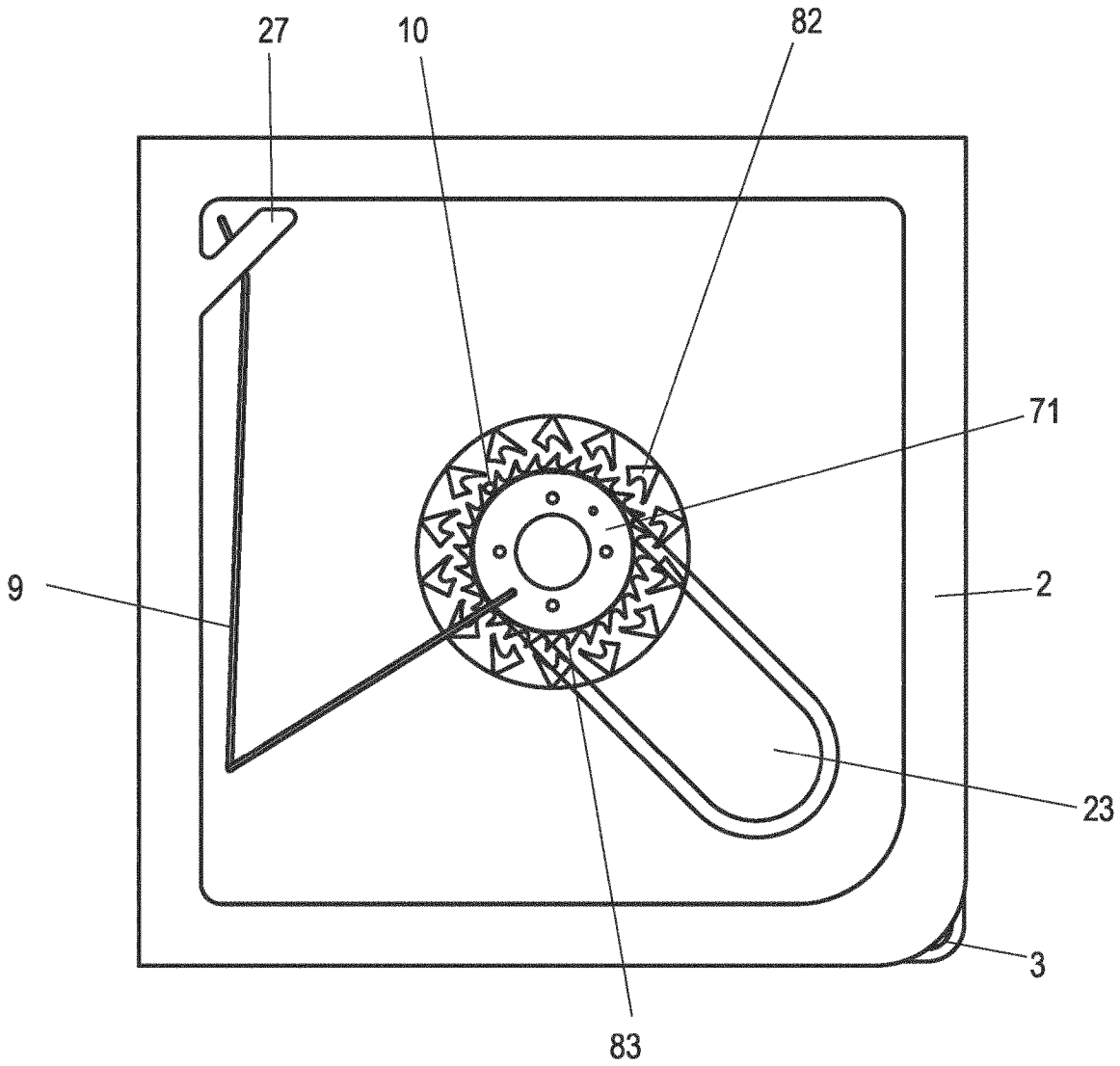

If the user then releases the carcass, this removal of pressure in turn activates the force accumulator 9, which presses the carcass 3 together with the guide element 71 and the control disk 8 in direction A, as shown in FIG. 18.

Figure 19:
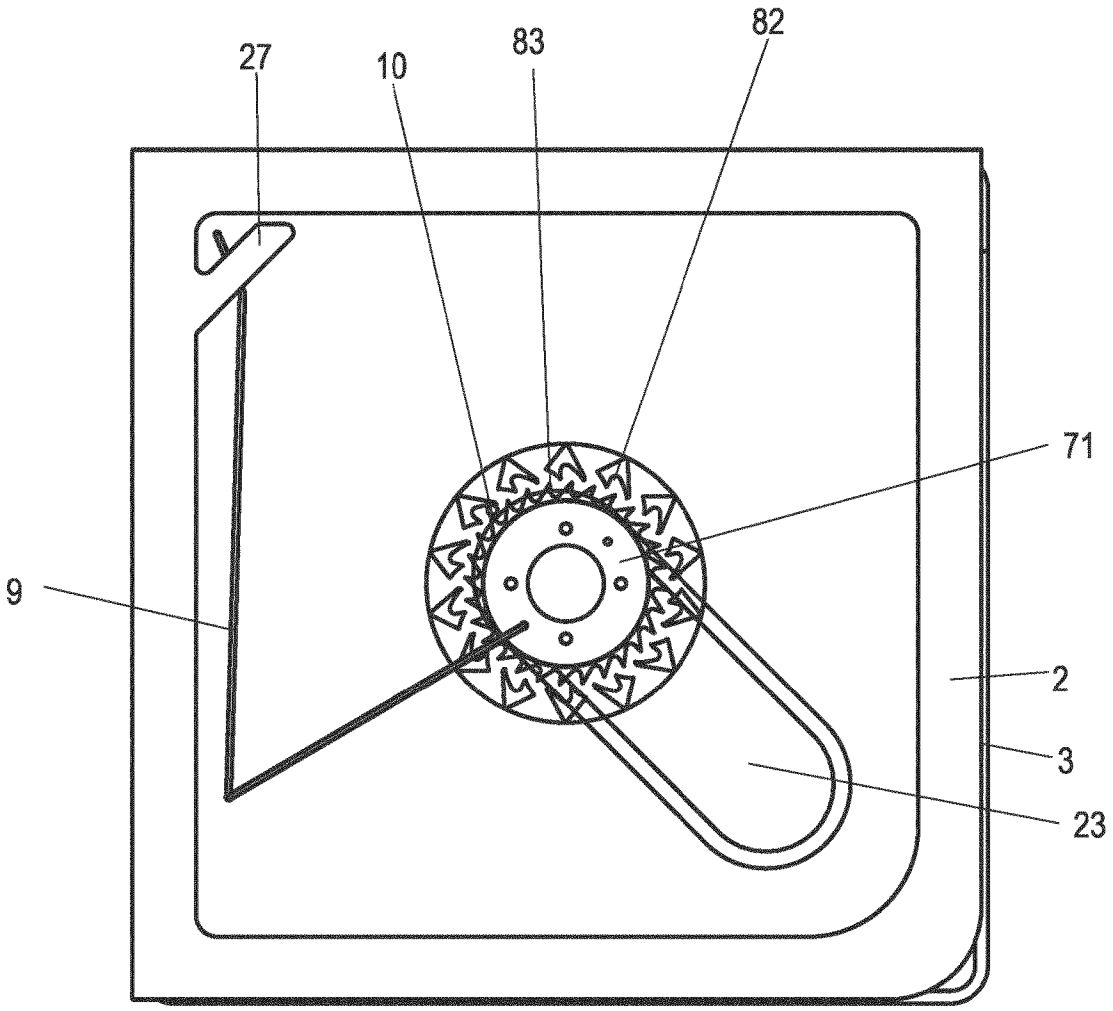

As shown in FIG. 19, the pin 10 thereby abuts the inner side of a leg of one of the first control elements 82 forming the recess 85.

In this process, the control disk 8 is rotated until the pin 10 is fully engaged in the recess 85 of one of the first control elements 82, as shown in FIG. 20, in this position, the carcass 3 is now completely in the open position, allowing easy access to the shelves 33.

If the carcass 3 is to be transferred back to the closed position, the movement sequence described above runs in the same order.

Accordingly, to initiate the movement of the carcass 3 into the closed position, the carcass 3 is unlocked by pressing.

This ensures that the carcass 3 cannot leave the end positions without manual operation and is supported into the open or closed position during movement.

Alternatively, the mechanism could be designed to optionally have only one locking in one end position and only one support in the opening movement or in the closing movement.

With reference to FIGS. 21 to 30, an alternative embodiment variant for a translational-rotational mounting of a furniture element 110 is described.

As shown in FIGS. 21 and 22, the bottom panel 120 also has running grooves 122 on its support surface 121 facing the support panel 161 for guiding rolling elements 151, here in the form of balls. The running grooves 162 of the support panel 161 are not shown.

The rolling elements 151 are also accommodated in a rolling element cage 150 for loss prevention. In contrast to the embodiment shown in FIG. 4, the rolling element cage 150 here is circular with several arms extending radially outward.

A guide channel 123 is also provided centrally and diagonally to two side edges of the bottom panel 120 which are aligned at right angles to each other.

A guide carriage 171 is displaceably mounted in this guide channel 123.

The guide carriage 171, as part of a fixing device 170, has on its upper side facing the support panel 161 or the carcass 130 of the furniture element 110 a bearing neck 172 projecting into an opening 163 in the support panel 161, which is preferably integrally formed on the upper skis of the guide carriage 171.

This bearing neck 172 serves as an axis for a rolling bearing ring 177 inserted into the opening 163 of the support panel 161, in particular a ball bearing ring, by means of which a simple rotational movement of the support panel 161 relative to the guide carriage 171 and thus relative to the bottom panel 120 is made possible.

On the underside of the guide carriage 171 facing away from the support panel 161, there is a roller bearing having at least two rollers 174 arranged, in particular fixed, one behind the other in the longitudinal direction of the guide channel 123.

Each of these rollers 174 has a circumferential v-shaped groove 175 into which protrude from opposite side walls of the guide channel 123 v-shaped webs 124 forming running surfaces for the rollers 174.

The v-shaped grooves 175 of the rollers 174, which are guided along the v-shaped webs 124 in the guide channel 123, result in an extremely stable and constant sequence of the translational-rotational movement of the furniture element 110. The fixing device 170 is secured against unintentional loosening at the top and bottom in each case by a fixing element, in particular a detachable fixing pin 176, 178. This makes it possible to assemble and disassemble the furniture element in a simple manner.

In this embodiment variant, the translational-rotational mounting is also preferably configured such that the guide carriage 171, analogous to the guide element 71, moves from an initial position in which the furniture carcass 130 is in an initial position relative to the stationary portion of the furniture item 100, during an opening movement, moves along the guide channel 123 to opposite ends of the guide channel 123, and moves from the opposite end of the guide channel 123 back to the initial position to reach an open position.

As shown in FIGS. 21 and 25 to 27, as an alternative to the mechanism shown in FIGS. 6 to 40 for opening and/or closing the carcass 3 with a force accumulator 9 assisting an opening and/or closing movement of the carcass 3, an ejector or push-to-move mechanism 140 with a plunger 142 coupled to a force accumulator 141 is used in the bottom panel 120.

With this ejector or push-to-move mechanism 140, the guide carriage 171 can be pushed away from an initial position or an open position along the guide channel 123 after activation thereof, thereby initiating the translational-rotational movement of the support panel 161 and thus of the furniture element 110.

As shown in FIGS. 25-27, the ejector or push-to-move mechanism 140 is accommodated on an underside of the bottom panel 120, facing away from the support panel 161, in a receiving groove 127 provided for this purpose, which here is fixed in its position in the receiving groove 127 by a retaining element 143 formed as a plate.

The plunger 142 thereby protrudes into the guide channel 123, as shown in FIGS. 26 and 27.

As a result, by approaching the guide carriage 171, the plunger 142 can be pressed against the force of the force accumulator 141, for example in the form of a compression spring, into a housing accommodating the force accumulator 141 and pressed into a latching position via a latching mechanism known from the prior art.

To activate the push-to-move mechanism 140, the plunger 142 must be pushed further into the housing from the position shown in FIG. 5 against an ejection direction, which is carried out by pressing against the carcass of the furniture element 110 against the ejection direction of the push-to-move mechanism 140.

When the push-to-move mechanism 140 is triggered, the guide carriage 171 is pushed away along the guide channel 123, thus causing the carcass 130 of the furniture element 110 to open.

In this case, the plunger 142 interacts with the guide carriage 171 in such a way that not only an opening movement of the carcass 130 of the furniture element 110 from an initial position, but also a closing movement of the carcass 130 of the furniture element 110 is supported, i.e., both directions of movement are supported with only one ejector or push-to-move mechanism 140.

Such an initial position is shown by way of example in FIG. 28. In this position, the carcass 130 of the furniture element 110 is positioned in the furniture item 100 in such a way that outer walls of the carcass 130 together with outer walls of the fixed part of the furniture item 100 close the furniture element to the outside.

In the open position shown as by way of example in FIG. 30, the carcass 130 of the furniture element 110 is positioned in the furniture item 100 in such a way that the two outer walls of the carcass 130 are positioned directly in front of the outer walls of the stationary part of the furniture item 100 and are not accessible from the outside by areas of the furniture element closed by external walls.

In both the initial position shown in FIG. 28 and the open position shown in FIG. 30, the guide carriage 171 is in the position shown in FIG. 25, as explained above.

According to a further preferred embodiment variant, a stop 173 is arranged on one end face of the guide carriage 171 to repel the guide carriage 171. When the guide carriage 171 approaches the plunger 142 of the ejector or push-to-move mechanism 140, the stop 173 abuts the plunger 142.

To illustrate the movement of the furniture element 110, FIGS. 23 and 24 show a bottom panel 120 resting on a base 101 of a piece of furniture, on which the support panel 161, which is attached to the underside of the furniture carcass 130 of the furniture element 110, is mounted so as to be movable in translation and rotation. Here, FIG. 23 shows the it position corresponding to a positioning of furniture elements 110 in the initial position shown in FIG. 28.

FIG. 24 shows a rotated position of the support panel 161 by approximately 65° relative to the base 101 and the bottom panel 120.

FIG. 25 shows the initial position shown in FIG. 23 from the underside of the bottom panel 120 and the support panel 161, in which the guide carriage 171 almost completely presses in the plunger 142 of the ejector or push-to-move mechanism 140.

FIG. 26 shows a 5° rotated position of the support panel 161 relative to the bottom panel 120 from the perspective corresponding to FIG. 25. In this position, the support panel 161 is translationally displaced by the distance of movement of the plunger 142 from the initial position.

FIG. 27 shows the open position of the support panel 161 relative to the bottom panel 120, which from a vertical view corresponds to the position of the furniture elements 110 in a furniture item of the representation according to FIG. 30, in which the furniture element 110 or the support panel 161 have been rotated by 180°.

The position of the furniture elements 110 with furniture carcass 130 according to the position shown in FIG. 29 corresponds to the representation of the support panel 161 relative to the bottom panel 120 and the base 101 in the position shown in FIG. 24.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way, in fact, the preceding description and the description of the figures enable the person skilled in the art to implement the exemplary embodiments in concrete manner, wherein, with the knowledge of the disclosed inventive, concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Furniture element
2 Bottom panel
21 Support surface
22 Running groove
23 Guide channel
24 Indentation
25 Frame
26 Bore
27 Counter web
28 Free end
3 Carcass
31 Support surface
32 Side wall
33 Shelf
4 Room corner
5 Rolling element cage
51 Rolling elements
6 Translational-rotational bearing
61 Support panel
62 Running groove
63 Opening
7 Fixing device
71 Guide element
72 Screw
73 Bore
8 Control disk
81 Ring
82 Control element
83 Control element
84 Opening
85 Recess
86 Tooth
9 Force accumulator
91 First leg
92 Second leg
93 First end
94 Second end
10 Pin
100 Furniture item
101 Base
110 Furniture element
120 Bottom panel
121 Support surface
122 Running groove
123 Guide channel
124 Web
127 Receiving groove
130 Carcass
140 Ejector element
141 Force accumulator
142 Plunger
143 Retaining element
150 Rolling element cage
151 Rolling element
161 Support panel
162 Running groove
163 Opening
170 Fixing device
171 Guide carriage
172 Bearing neck
173 Stop
174 Roper
175 Groove
176 Fixing pin
177 Rolling bearing ring
173 Fixing pin
A Direction
$R_1$, $R_2$ Direction of rotation

The invention claimed is:

1. A furniture element, which is a shelf or rack having at least one support plane, the furniture element comprising:
a carcass; and
a bottom panel;
a mechanism configured to open or close the carcass includes a force accumulator supporting an opening or closing movement of the carcass,
wherein mutually facing support surfaces of the bottom panel and the carcass or a support panel attached to an underside of the carcass each have at least one running groove in which rolling elements are guided,
wherein the carcass is movable relative to the bottom panel from an initial position to an intermediate position and further to an open position and back,
wherein in the intermediate position the carcass is rotated relative to the bottom panel in a direction of rotation and displaced in a predetermined direction,
wherein the furniture element further comprises a guide channel configured to predetermine the direction is arranged in the bottom panel,
wherein a guide element is displaceably mounted in the guide channel and the mechanism configured to open or close the carcass is coupled to the guide element, wherein the force accumulator is fixed to the bottom panel and coupled to the guide element to support a displacement movement in the guide channel.

2. The furniture element of claim 1, wherein the mechanism configured to open or close the carcass is arranged on a surface of the bottom panel facing away from the carcass.

3. The furniture element of claim 1, wherein the mechanism configured to open or close the carcass comprises a pin projecting from a surface of the bottom panel facing away from the carcass and a control disk arranged movably in rotation on the guide element and having a plurality of control elements configured to control movement of the control disk relative to the pin.

4. The furniture element of claim 3, wherein the control disk is configured as a ring with a central opening encompassing the guide element, wherein the plurality of control elements are integrally formed on a ring surface facing the bottom panel.

5. The furniture element of claim 4, wherein the plurality of control elements comprise first control elements configured as catch elements arranged circularly and at equal angular distance from each other with a recess open towards the center of the control disk.

6. The furniture element of claim 5, wherein the plurality of control elements further comprise a second control element configured as a toothed ring arranged between the first control elements and the central opening and having teeth arranged at equal angular distance from one another and directed towards the first control elements, wherein the teeth and an imaginary central perpendicular of the recesses of the first control elements are aligned with one another in an angular range of 60° to 120°.

7. The furniture element of claim 1, wherein the force accumulator is a torsion spring.

8. The furniture element of claim 7, wherein the torsion spring is fixed with a first end in a bore in a surface of the bottom panel facing away from the carcass.

9. The furniture element of claim 8, wherein the torsion spring is fixed with a second end in a bore in a surface of the guide element facing away from the carcass.

10. The furniture element of claim 1, wherein a surface of the bottom panel facing away from the carcass has an indentation in which the mechanism configured to open or close the carcass is inserted.

11. The furniture element of claim 1, wherein the guide element is part of a fixing device configured to vertically fix the bottom panel to the carcass of the furniture element.

12. The furniture element of claim 1, wherein a guide carriage displaceably mounted in guide channel, wherein the guide carriage is part of a fixing device configured to vertically fix the bottom panel to the carcass.

13. The furniture element of claim 12, wherein the fixing device has a roller bearing arranged on an underside of the guide carriage facing away from the carcass and has at least two rollers arranged one behind the other in a longitudinal direction of the guide channel, wherein the at least two rollers have circumferential v-shaped grooves into which protrude webs forming v-shaped running surfaces for the at least two rollers from opposite side walls of the guide channel.

14. The furniture element of claim 13, further comprising:

a bearing neck projecting into a bore of the support panel is integrally formed on an upper side of the guide carriage facing the carcass, on which bearing neck a rolling bearing ring inserted into the bore is fitted to rotary mount the support panel.

15. A furniture element, which is a shelf or rack having at least one support plane, the furniture element comprising:

a carcass; and a bottom panel;

a mechanism configured to open or close the carcass includes a force accumulator supporting an opening or closing movement of the carcass, wherein mutually facing support surfaces of the bottom panel and the carcass or a support panel attached to an underside of the carcass each have at least one running groove in which rolling elements are guided, wherein the carcass is movable relative to the bottom panel from an initial position to an intermediate position and further to an open position and back, wherein in the intermediate position the carcass is rotated relative to the bottom panel in a direction of rotation and displaced in a predetermined direction, wherein the furniture element further comprises a guide channel that predetermines the direction and in which a guide carriage is displaceably mounted is provided in the bottom panel, wherein the mechanism configured to open or close the carcass and including the force accumulator supporting the opening or closing movement of the carcass is an ejector or push-to-move mechanism with a plunger coupled to the force accumulator, with which plunger the guide carriage is configured to be pushed away from a starting position along the guide channel.

16. The furniture element of claim 15, wherein the guide carriage is part of a fixing device configured to vertically fix the bottom panel to the carcass.

17. The furniture element of claim 16, wherein the fixing device has a roller bearing arranged on an underside of the guide carriage facing away from the carcass and has at least two rollers arranged one behind the other in a longitudinal direction of the guide channel, wherein the at least two rollers have circumferential v-shaped grooves into which protrude webs forming v-shaped running surfaces for the at least two rollers from opposite side walls of the guide channel.

18. The furniture element of claim 17, further comprising:

a bearing neck projecting into a bore of the support panel is integrally formed on an upper side of the guide carriage facing the carcass, on which bearing neck a rolling bearing ring inserted into the bore is fitted to rotary mount the support panel.

19. The furniture element of claim 15, further comprising:

a stop arranged on an end face of the guide carriage, which stop abuts against the plunger of the ejector or push-to-move mechanism when the guide carriage approaches.

* * * * *